US012318665B2

(12) United States Patent
Rabatin et al.

(10) Patent No.: US 12,318,665 B2
(45) Date of Patent: Jun. 3, 2025

(54) GOLF BALL COMPOSITIONS WITH METAMATERIAL

(71) Applicant: Acushnet Company, Fairhaven, MA (US)

(72) Inventors: Glenn Rabatin, Saint Marys, OH (US); Christopher Cavallaro, Lakeville, MA (US)

(73) Assignee: Acushnet Company, Fairhaven, MA (US)

( * ) Notice: Subject to any disclaimer, the term of this patent is extended or adjusted under 35 U.S.C. 154(b) by 6 days.

(21) Appl. No.: 17/987,248

(22) Filed: Nov. 15, 2022

(65) Prior Publication Data

US 2024/0157200 A1 May 16, 2024

(51) Int. Cl.
*A63B 37/06* (2006.01)
*A63B 37/00* (2006.01)

(52) U.S. Cl.
CPC ..... *A63B 37/0039* (2013.01); *A63B 37/0029* (2013.01); *A63B 37/004* (2013.01); *A63B 37/006* (2013.01); *A63B 37/0076* (2013.01); *A63B 37/0078* (2013.01); *A63B 2209/08* (2013.01)

(58) Field of Classification Search
CPC ..... A63B 37/005; A63B 37/0051; A63B 37/0061
See application file for complete search history.

(56) References Cited

U.S. PATENT DOCUMENTS

| | | | | |
|---|---|---|---|---|
| 6,677,401 | B2 | 1/2004 | Boehm et al. | |
| 6,756,436 | B2 | 6/2004 | Rajagopalan et al. | |
| 6,774,187 | B2 | 8/2004 | Voorheis et al. | |
| 6,982,301 | B1 | 1/2006 | Voorheis et al. | |
| 6,992,135 | B2 | 1/2006 | Boehm et al. | |
| 2004/0034122 | A1* | 2/2004 | Lacy | A63B 37/0022 523/210 |
| 2008/0045358 | A1* | 2/2008 | VanDelden | A63B 69/3658 473/409 |
| 2010/0081517 | A1* | 4/2010 | Sullivan | A63B 37/0033 473/376 |
| 2013/0324324 | A1* | 12/2013 | Ishii | A63B 37/0003 473/371 |

OTHER PUBLICATIONS

Dalton, Jeff, "Compression by Any Other Name", Science and Golf IV, Proceedings of the World Scientific Congress of Golf (Eric Thain ed., Routledge, 2002), pp. 319-327.
Liang, Xudong et al., "Phase-transforming metamaterial with magnetic interactions", PNAS, 2022, vol. 119, No. 1, pp. 1-8; https://doi.org/10.1073/pnas.2118161119.

* cited by examiner

*Primary Examiner* — Raeann Gorden
(74) *Attorney, Agent, or Firm* — Bradley Arant Boult Cummings LLP

(57) ABSTRACT

Compositions including a resiliency additive and golf ball components made from such compositions having a tailored Coefficient of Restitution are disclosed. The type and concentration of the constituents in the composition, including the resiliency additive, affects the Coefficient of Restitution of components made from the composition and, thus, can be used to produce a golf ball having desirable performance characteristics.

21 Claims, 7 Drawing Sheets

GOLF BALL COMPOSITIONS WITH METAMATERIAL

FIELD OF THE INVENTION

The present disclosure relates generally to compositions for use in golf balls that produce highly resilient golf balls. More particularly, the present disclosure provides compositions and golf ball components made from such compositions that provide the ability to tailor and/or improve certain ball performance characteristics when such components are used in a golf ball. In some respects, the present disclosure relates to golf ball components with increased resiliency and rebounding that, when used in golf balls, provide the ability to achieve one or more desired performance characteristics including, for example, increased distance on driver and iron shots.

BACKGROUND OF THE INVENTION

The flight performance of a golf ball is affected by a variety of factors including the materials, weight, size, dimple pattern, and external shape of the golf ball. As a result, golf ball manufacturers are constantly improving or tweaking the performance of golf balls by adjusting the materials and construction of the ball as well as the dimple pattern and dimple shape.

For example, the resiliency and rebounding performance of a golf ball are generally driven by the composition and construction of the core and cover, among other components. The coefficient of restitution (CoR) is a direct measure of the resilience of a golf ball at a particular inbound velocity. A golf ball's CoR is the ratio of the relative velocity of the ball after direct impact to that before impact. One way to measure the CoR is to propel a ball at a given speed against a hard ungiving surface and measure its incoming velocity and outgoing velocity. The CoR is defined as the ratio of the outgoing velocity to the incoming velocity of a rebounding ball and is expressed as a decimal. The CoR can vary from zero to one, with one being equivalent to an elastic collision and zero being equivalent to an inelastic collision. A golf ball with a high CoR value will generally have an increased initial velocity and increased distance on a given shot compared to a golf ball with a low CoR value. A golf ball with a high CoR value may be particularly desirable for less skilled or weaker players, such as recreational players, children, seniors, or disabled players.

Recently, there has been an increased desire to manipulate golf ball cores to produce reduced-flight golf balls (i.e., golf balls that are designed to travel a distance that is shorter than the distance traveled by standard golf balls). Advances in golf ball compositions and dimple designs have caused high-performance golf balls to exceed the maximum distance allowed by the United States Golf Association (USGA). Some industry experts have called for the USGA to roll back the distance standard for golf balls to preserve the game. Thus, it is desirable in some cases to produce a golf ball core with a lower CoR value.

Golf ball resilience is also constrained by the compositions used to form various golf ball components. In particular, golf ball resilience may also be influenced by the ambient environmental conditions during manufacturing and storage. As a result, golf ball manufacturers are constantly monitoring manufacturing conditions and adjusting the compositions of golf ball components to maintain the targeted properties of golf balls, such as the CoR.

Accordingly, there remains a need in the art for compositions that allow formation of golf ball components that can be tailored to produce a finished golf ball having a desired and/or targeted CoR. Particularly, there is a need for compositions and golf ball components made from such compositions that can be tailored to have a desired and/or targeted CoR. In this respect, it would be advantageous to provide a composition for use in golf ball components such that the finished golf ball has the desired CoR for players having different levels of expertise as well as other advantageous properties, features, and benefits. For example, it would be beneficial to tailor the composition used to form a core and/or a cover of a golf ball to increase shot distance for amateur, young, senior, or disabled players. In other cases, it would be advantageous to tailor the composition used to form one or more components of a golf ball such that the finished golf ball has a decreased shot distance to comply with USGA regulations or to preserve the nature of the game. In another aspect, there remains a need for golf ball components that can be tailored to minimize the physical property variation, such as variation in the CoR value of a golf ball, associated with prior art compositions and manufacturing methods. The present disclosure provides compositions for use in golf ball components and golf balls containing such components that allow for controlled manipulation of the CoR and other physical properties of a golf ball, and, thus, manipulation or tailoring of desired performance characteristics.

SUMMARY OF THE INVENTION

The problems expounded above, as well as others, are addressed by the following inventions, although it is to be understood that not every embodiment of the inventions described herein will address each of the problems described above.

In some embodiments, the present disclosure provides a golf ball including a core and a cover layer disposed about the core and formed from a cover composition including a resiliency additive, wherein the resiliency additive is an elasto-magnetic metamaterial. In another embodiment, the resiliency additive includes a polymeric network and plurality of magnets contained in the polymeric network. In yet another embodiment, the polymeric network includes a plurality of plates including the plurality of magnets and a plurality of pores disposed between the plates. In still another embodiment, the polymeric network includes closed and open phases. In a further embodiment, the polymeric network is configured to transition between the open phase and the closed phase when struck by a golf club.

In one embodiment, the plurality of magnets includes a first magnet and a second magnet, and the first magnet and second magnet are configured to attract each other. In another embodiment, the plurality of magnets includes a first magnet and a second magnet, and the first magnet and second magnet are configured to repel each other. In yet another embodiment, the plurality of magnets may include neodymium magnets. In still another embodiment, each magnet in the plurality of magnets includes a magnetic moment having a direction, and the direction of the magnetic moment of each magnet extends substantially parallel to the magnetic moment of each other magnet. In yet another embodiment, the core includes a geometric center, wherein each magnet in the plurality of magnets includes a magnetic moment having a direction, and wherein the direction of the magnetic moment of each magnet is substantially colinear with a line passing through the geometric center of the core.

In a further embodiment, the resiliency additive is included in the cover composition in an amount of about 5 to about 50 percent by weight. In some embodiments, the golf ball has a coefficient of restitution between about 0.700 and about 0.950. In other embodiments, the golf ball has a coefficient of restitution between about 0.500 and about 0.700.

In some embodiments, the present disclosure provides a golf ball including a core and a dual cover layer disposed about the core, the dual cover layer including an inner cover layer formed from a first cover composition having a first resiliency additive and an outer cover layer disposed over the inner cover layer and formed from a second cover composition, wherein the first resiliency additive includes an elasto-magnetic metamaterial. In another embodiment, the second cover composition may include a second resiliency additive that includes an elasto-magnetic metamaterial.

In one embodiment, the first resiliency additive includes a first polymeric network and a first plurality of magnets contained in the first polymeric network, and the second resiliency additive includes a second polymeric network and a second plurality of magnets contained in the second polymeric network. In another embodiment, at least one of the magnets in the first plurality of magnets and at least one of the magnets in the second plurality of magnets are configured to attract each other. In still another embodiment, at least one of the magnets in the first plurality of magnets and at least one of the magnets in the second plurality of magnets are configured to repel each other. In a further embodiment, the second cover composition includes a magnetic shielding agent. In some embodiments, the golf ball has a coefficient of restitution between about 0.700 and about 0.950. In other embodiments, the golf ball has a coefficient of restitution between about 0.500 and about 0.700.

BRIEF DESCRIPTION OF THE DRAWINGS

Further features and advantages of the invention can be ascertained from the following detailed description that is provided in connection with the drawings described below.

DETAILED DESCRIPTION OF THE INVENTION

Figure 1:
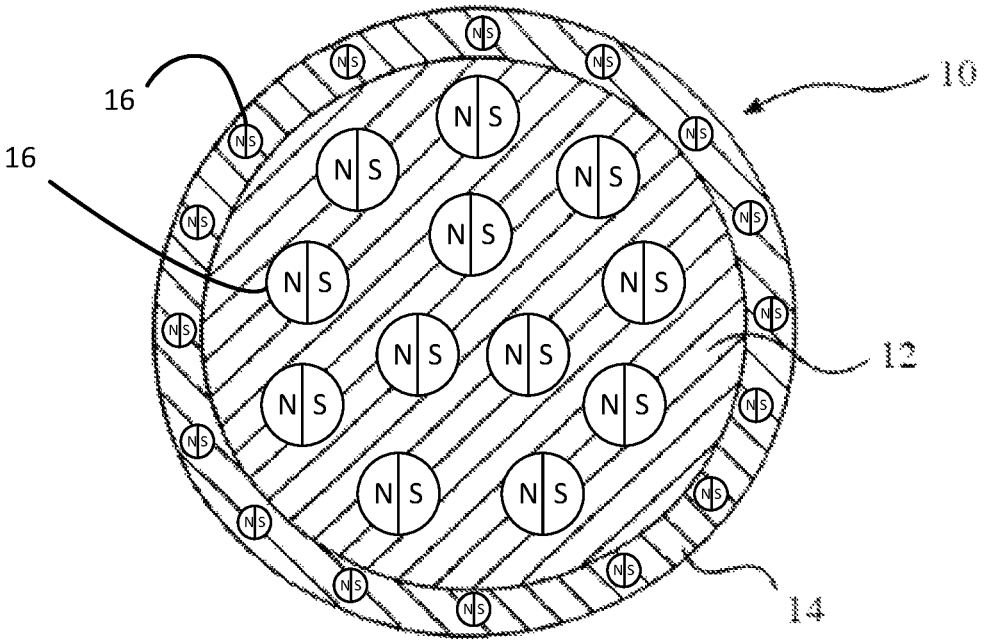
FIG. 1 is a cross-sectional view of a two-piece golf ball in accordance with an embodiment of the present disclosure.

The present disclosure relates to compositions that may be used to produce golf ball components with a desired Coefficient of Restitution (CoR), components including such compositions, and golf balls including such components. In some respects, tailoring the CoR of a golf ball formed in accordance with the present disclosure provides the ability to increase or decrease shot distance and initial velocity when compared to a conventional golf ball hit under the same conditions. In addition, manipulation of the CoR of a golf ball formed in accordance with the present disclosure may be used to minimize disparities in golf ball performance due to variations in physical properties of the golf ball associated with changes in ambient environmental conditions during manufacturing using standard materials and manufacturing techniques.

While golf ball components generally are functionally different from each other and operate somewhat independently, certain components such as the core and cover of a golf ball greatly influence the overall performance of the finished golf ball including such a core or cover. In this regard and without being bound by any particular theory, the performance characteristics of a finished golf ball that contains a core or cover of the present disclosure may be tailored by changing the composition of the core or cover. For example, altering the core or cover composition and, thus, the CoR of a golf ball including such core or cover, may have a significant effect on both long shots, e.g., shots made with a driver, and approach shots, e.g., shots made with irons and wedges. In fact, adjusting the CoR of golf ball cores or covers made in accordance with this present disclosure, even in relatively small amounts, can significantly affect how a golf ball performs on long- and short-distance shots. Similarly, adjusting the CoR of the core or cover may allow for tailoring of other performance characteristics of the finished golf ball. The inventive compositions, cores or covers made using the compositions, golf balls including such cores or covers, and resulting performance characteristics are discussed in greater detail below.

Resiliency Additive

The compositions of the present disclosure may include a resiliency additive. A resiliency additive may be included in the composition of a golf ball component to manipulate the CoR of that particular golf ball component. For example, compositions of the present disclosure including a resiliency additive may be used to form a golf ball core or cover. As discussed in greater detail below, the effect of the resiliency additive on the CoR may depend on the type and structure of the resiliency additive used and the particular components(s) of the golf ball into which the resiliency additive is incorporated. The resiliency additive may take the form of an elasto-magnetic metamaterial including magnets and/or a polymeric network that includes a plurality of magnets embedded therein. In some embodiments, the resiliency additive may include a plurality of magnets embedded directly in the golf ball component. In other embodiments, the resiliency additive takes the form of a plurality of magnets embedded in one or more polymeric networks in the golf ball component.

In either aspect, the magnets of the resiliency additive may have a north pole, a south pole and a magnetic moment (also referred to as a magnetic dipole moment). The magnetic moment is a vector quantity having a direction pointing from the south pole to the north pole of the magnet and strength determined by the physical properties of the magnet (such as the composition and size). Without being bound to any particular theory, the orientation of the magnets and their poles, and the resulting interaction of the magnetic forces between the magnets may affect the CoR of the golf ball, as discussed in greater detail below.

Magnets suitable for use in accordance with the present disclosure may include permanent magnets, temporary magnets, electromagnets, and combinations thereof. A permanent magnet is a material that is magnetized and creates its own persistent magnetic field. Examples of metals and metal alloys suitable for use as permanent magnets in accordance with the present disclosure include, but are not limited to, neodymium magnets (also referred to as neodymium iron boron or NdFeB magnets), samarium cobalt magnets (also referred to as SmCo magnets), AlNiCo magnets (also referred to as aluminum nickel cobalt magnets), and ceramic magnets (also referred to as ferrite magnets). A temporary magnet is a material that does not possess its own magnetism but becomes magnetized when subjected to a magnetic field. Examples of metals and alloys suitable for use as temporary magnets in accordance with the present disclosure include, but are not limited to, lead, aluminum, iron, nickel, and alloys thereof. Like a temporary magnet, an electromagnet does not possess its own magnetism. An electromagnet becomes magnetized when subjected to an electric current. Examples of metals and metal alloys suitable for use as electromagnets in accordance with the present disclosure include, but are not limited to, copper, iron, steel, and cobalt.

Magnets suitable for use in accordance with the present disclosure may be included in various shapes depending on the desired characteristics of the golf ball component and finished golf ball including such golf ball component. In some embodiments, the magnets may be amorphous, i.e., the magnets do not have a defined shape. In other embodiments, each magnet may have a defined shape. Suitable shapes for magnets include, but are not limited to, spheres, hemispheres, cylinders, discs, cones, square-based pyramids, polyhedrons, prisms, and combinations thereof. In some embodiments, each magnet may be the same shape. In other embodiments, the magnets may vary in shape. Without being bound to any particular theory, the shape of the magnet may affect the magnetic interaction between magnets as well as other properties, such as the weight distribution within the golf ball core or cover. In still other embodiments, the magnets may be a combination of amorphous magnets and magnets with a defined shape. For example, the plurality of magnets that are either embedded directly in the golf ball core or cover or embedded in one or more polymeric networks (depending on the embodiment) may include a mixture of amorphous magnets and defined shape magnets. In some embodiments, the plurality of magnets may include about 10 percent to about 50 percent amorphous magnets and about 50 percent to about 90 percent defined shape magnets. In other embodiments, the plurality of magnets may include about 50 percent to about 90 percent amorphous magnets and about 10 percent to about 50 percent defined shape magnets.

Magnets suitable for use in accordance with the present disclosure may be included in various sizes depending on the desired characteristics of the golf ball core or cover. The magnets may be on the scale of nanoparticles, microparticles, or larger. For example, the magnets may be about 1 nm to about 1 cm in size. In one embodiment, the magnets may be about 1 nm to about 1000 nm in size or about 1 nm to about 500 nm in size or about 500 nm to about 1000 nm in size or about 300 nm to about 700 nm in size. In another embodiment, the magnets may be about 1 μm to about 1000 μm in size or about 1 μm to about 500 μm in size or about 500 μm to about 1000 μm in size or about 300 μm to about 700 μm in size. In still another embodiment, the magnets may be about 1 mm to about 10 mm in size or about 1 mm to about 5 mm in size or about 5 mm to about 10 mm in size or about 3 mm to about 7 mm in size. In some embodiments, each of the magnets in the plurality of magnets may be approximately the same size. In other embodiments, the magnets in the plurality of magnets may differ in size. For example, the plurality of magnets may include nanoparticles and microparticles.

The polymeric network of an elasto-magnetic metamaterial may be formed from a polymer including, but not limited to, polybutadiene, polyisoprene, ethylene propylene rubber, ethylene-propylene-diene rubber, styrene-butadiene rubber, styrenic block copolymer rubbers, polyalkenamers such as, for example, polyoctenamer, butyl rubber, halobutyl rubber, polystyrene elastomers, polyethylene elastomers, polyurethane elastomers, polyurea elastomers, metallocene-catalyzed elastomers and plastomers, copolymers of isobutylene and p-alkylstyrene, halogenated copolymers of isobutylene and p-alkylstyrene, copolymers of butadiene with acrylonitrile, polychloroprene, alkyl acrylate rubber, chlorinated isoprene rubber, acrylonitrile chlorinated isoprene rubber, and blends of two or more thereof. In one embodiment, for example, the polymeric network is composed of polyurethane having a hardness of at least about 40 Shore A. The polymeric network may also include one or more of the co-agents, fillers, radical scavengers, initiators, or other additives discussed herein. The polymer of the polymeric network may be the same as or different from other materials used in the golf ball component in which the polymeric network is included, such as the base rubber of the core composition. For example, when the base rubber of the core is polybutadiene, the polymer of the polymer network included in the core may also be polybutadiene, a blend of base rubbers including polybutadiene, or a different polymer altogether. In some embodiments, the polymer of the polymeric network is blended with the other materials in the golf ball component such that the polymeric network is an integral part of the golf ball component. In other embodiments, the polymer of the polymeric network does not blend with the other materials in the golf ball component such that the polymeric network is a distinct component embedded in the golf ball component.

The polymeric network included in the composition of a golf ball component in accordance with the present disclosure may vary in shape depending on the desired performance characteristics of the golf ball component. More specifically, the polymer network may vary in shape depending on the desired performance characteristics of the golf ball core, if the composition of the present disclosure is used to form one or more portions/layers the golf ball core. In some embodiments, the polymeric network may include a plurality of subunits, referred to herein as plates. The subunits may be arranged to give the polymeric network itself a desired shape. In some embodiments, the polymeric network may be in the shape of a chain. In this aspect, the chain may be one or more units wide. In other embodiments, the polymeric network may be in the shape of a plane formed from a single layer of plates. In further embodiments, a polymeric network may be a three-dimensional shape including, but not limited to, spheres, hemispheres, cylinders, discs, cones, square-based pyramids, polyhedrons, or prisms.

Plates of the polymeric network suitable for use in accordance with the present disclosure may be included in various shapes depending on the desired characteristics of the golf ball component. Suitable shapes for the plates of the polymeric network include, but not limited to, spheres, hemispheres, cylinders, discs, cones, square-based pyramids, polyhedrons, or prisms. The plates forming a polymeric network may all be the same shape or the plates forming a polymeric network may be different in shape. In some embodiments, each plate forming the polymeric network may be connected to one or more other plates by one or more ligaments. In this aspect, each ligament may connect an edge or vertex of one plate to an edge or vertex of another plate. The thickness and position of the ligaments may affect the properties of the polymeric network and, in turn, the properties of the golf ball component.

In other embodiments, the polymeric network may include a plurality of pores to allow for expansion and compression of the polymeric network. The shape and position of the pores may be determined by the shape and position of the plates in the polymeric network. In one embodiment, for example, the polymeric network includes a plurality of rectangular-prism-shaped plates separated by orthogonally aligned pores. In such an embodiment, each plate may be connected to at least two other plates via ligaments. In this aspect, the polymeric network may have an open phase and a closed phase. As used herein, the polymeric network is said to be in an open phase when the pores are open, i.e., when the pores separate the sides of the plates. Also as used herein, the polymeric network is said to be in a closed phase when the pores are closed, i.e., when the pores do not separate the sides of the plates. A polymeric network may be said to be in a transitional phase when some pores of the polymeric network are open and some pores of the polymeric network are closed. In a relaxed state, the polymeric network may be in an open phase, a closed phase, or a combination thereof. The polymeric network may fully or partially transition between the open phase and the closed phase. For example, in some embodiments, a golf ball core or cover formed in accordance with the present disclosure may include a resiliency additive having a polymeric network that is open phase in a relaxed state. During play, the polymeric network of such a golf ball core or cover may fully or partially transition from the open phase to the closed phase when the golf ball is struck by a golf club and may fully or partially transition back from the closed phase to the open phase as the golf ball moves away from the golf club. In some embodiments, the polymeric network of the golf ball core or cover may oscillate between the open phase and the closed phase after the ball is struck by a golf club.

Each plate may also have one or more cavities for receiving and securing magnets. Each cavity may receive one, two, three, or four or more magnets. A cavity may be disposed centric or eccentric within the plate. In embodiments having one or more cavities, the cavities may be disposed in a desired arrangement. For example, in an embodiment having a plate with two cavities, the cavities may be placed adjacent to one another or on opposite ends of the plate. In some embodiments, the cavity may be shaped as the inverse of the shape of the magnet to be received. For example, if the magnet is cylindrical, the cavity may be a hollow cylinder configured to receive the magnet. In one embodiment, the cavity may fully envelop the magnet such that the magnet cannot be removed from the plate. In another embodiment, the plate may include an aperture exposing the cavity and, when present, the magnet, to the surrounding environment. The cavity in each plate may have a flange around the aperture to prevent the magnet from exiting the cavity through the aperture. The magnet may also be press-fit in the cavity to prevent the magnet from exiting the cavity. In one embodiment, a magnet may be secured in a cavity of a plate such that the magnet cannot move or rotate within the cavity. In another embodiment, a magnet may be secured in a cavity of a plate such that the magnet cannot move or rotate within the cavity unless acted on by a force external to the golf ball core or cover, such as an external magnetic force.

The properties of the polymeric network and the magnets embedded therein may affect the phase transitions of the polymeric network. In this regard, properties of the polymeric network that may affect the phase transitions of the polymeric network include, but are not limited to, the composition of the polymeric network, the shape and size of the plates, the shape and size of the pores, and the ligament thickness. Properties of the magnets that may affect the phase transition of the polymeric network include, but are not limited to, the composition, shape, and size of the magnets, and the relative orientation of the magnets (as discussed in greater detail below). Without being bound to any particular theory, the properties of a golf ball core or cover formed in accordance with the present disclosure, e.g., including a base rubber and a resiliency additive, may be affected and/or controlled using the phase transitions of the polymeric network.

Compositions

Core Compositions

A golf ball of the present disclosure may contain a single- or multi-layered core. As discussed in more detail below, one or more of the layers of the core may include a core composition including a base rubber and one or more components. If the core is a multi-layered core, the core composition of different layers may be the same or different. Concentrations of components are in parts per hundred (phr) unless otherwise indicated. As used herein, the term, "parts per hundred," also known as "phr" or "pph" is defined as the number of parts by weight of a particular component present in a mixture, relative to 100 parts by weight of the polymer component. Mathematically, this can be expressed as the weight of an ingredient divided by the total weight of the polymer, multiplied by a factor of 100.

In some embodiments, the base rubber is included in the core composition in an amount of about 5 percent to 100 percent by weight based on the total weight of the core composition. In one embodiment, the base rubber is included in the core composition in an amount within a range having a lower limit of about 5 percent or 10 percent or 20 percent or 30 percent or 40 percent or 50 percent or 55 percent and an upper limit of about 60 percent or 70 percent or 80 percent or 90 percent or 95 percent or 100 percent. For example, the base rubber may be present in the core composition in an amount of about 30 percent to about 90 percent or about 40 percent to about 80 percent by weight base rubber based on the total weight of the core composition. In another example, the core composition includes about 50 percent to about 70 percent or about 60 percent to about 70 percent by weight base rubber based on the total weight of the core composition.

The base rubber may be polybutadiene, polyisoprene, ethylene propylene rubber, ethylene-propylene-diene rubber, styrene-butadiene rubber, styrenic block copolymer rubbers, polyalkenamers such as, for example, polyoctenamer, butyl rubber, halobutyl rubber, polystyrene elastomers, polyethylene elastomers, polyurethane elastomers, polyurea elastomers, metallocene-catalyzed elastomers and plastomers, copolymers of isobutylene and p-alkylstyrene, halogenated copolymers of isobutylene and p-alkylstyrene, copolymers of butadiene with acrylonitrile, polychloroprene, alkyl acrylate rubber, chlorinated isoprene rubber, acrylonitrile chlorinated isoprene rubber, and blends of two or more thereof. In one embodiment, the core composition includes polybutadiene rubber, butyl rubber, or a blend thereof as the base rubber.

For example, the core may be formed from a core composition that includes polybutadiene as the base rubber. Polybutadiene is a homopolymer of 1,3-butadiene. The double bonds in the 1,3-butadiene monomer are attacked by catalysts to grow the polymer chain and form a polybutadiene polymer having a desired molecular weight. Any suitable catalyst may be used to synthesize the polybutadiene rubber depending upon the desired properties. In one embodiment, a transition metal complex (for example, neodymium, nickel, or cobalt) or an alkyl metal such as alkyl lithium is used as a catalyst. Other suitable catalysts include, but are not limited to, aluminum, boron, lithium, titanium, and combinations thereof. As would be appreciated by those of ordinary skill in the art, different catalysts produce polybutadiene rubbers having different chemical structures. In a cis-bond configuration, the main internal polymer chain of the polybutadiene appears on the same side of the carbon-carbon double bond contained in the polybutadiene. In a trans-bond configuration, the main internal polymer chain is on opposite sides of the internal carbon-carbon double bond in the polybutadiene. The polybutadiene rubber used as a base rubber in accordance with the present disclosure can have various combinations of cis- and trans-bond structures. For example, the polybutadiene rubber may have a 1,4 cis-bond content of at least 40 percent. In another embodiment, the polybutadiene rubber has a 1,4 cis-bond content of greater than 60 percent. In yet another embodiment, the polybutadiene rubber has a 1,4 cis-bond content of greater than 80 percent. In still another embodiment, the polybutadiene rubber has a 1,4 cis-bond content of greater than 90 percent. In general, polybutadiene rubbers having a high 1,4 cis-bond content have high tensile strength and rebound.

In some embodiments, the core composition of the present disclosure includes a blend of base rubbers and, more specifically, a blend of two or more polybutadiene rubbers. In this aspect, the core composition may include a blend of a first polybutadiene rubber and a second polybutadiene rubber in a ratio of about 5:95 to about 95:5. For example, the core composition may include a first polybutadiene rubber and a second polybutadiene rubber in a ratio of about 10:90 to about 90:10 or about 15:85 to about 85:15 or about 20:80 to about 80:20 or about 30:70 to about 70:30 or about 40:60 to about 60:40. In other embodiments, the core composition may include a blend of more than two polybutadiene rubbers or a blend of polybutadiene rubbers with any of the other elastomers discussed above.

The polybutadiene rubber may have a relatively high or low Mooney viscosity. Generally, polybutadiene rubbers of higher molecular weight and higher Mooney viscosity have better resiliency than polybutadiene rubbers of lower molecular weight and lower Mooney viscosity. However, as the Mooney viscosity increases, the milling and processing of the polybutadiene rubber generally becomes more difficult. Blends of high and low Mooney viscosity polybutadiene rubbers may be prepared as is described in U.S. Pat. Nos. 6,982,301 and 6,774,187, the disclosures of which are hereby incorporated by reference, and used in accordance with this invention. In general, the lower limit of Mooney viscosity may be about 30 or 35 or 40 or 45 or 50 or 55 or 60 or 70 or 75 and the upper limit may be about 80 or 85 or 90 or 95 or 100 or 105 or 110 or 115 or 120 or 125 or 130. For example, the polybutadiene used in the core composition has a Mooney viscosity of about 30 to about 130. In some aspects, the polybutadiene used in the core composition may have a Mooney viscosity of about 30 to about 80 or about 75 to about 130.

Examples of commercially available polybutadiene rubbers that can be used in core composition in accordance with this invention, include, but are not limited to, PR-040G, available from CHIMEI Corporation of Tainan City, Taiwan; BR 01 and BR 1220, available from BST Elastomers of Bangkok, Thailand; SE BR 1220LA and SE BR1203, available from DOW Chemical Co of Midland, Mich.; BUDENE 1207, 1207s, 1208, and 1280 available from Goodyear, Inc of Akron, Ohio; BR 01, 51 and 730, available from Japan Synthetic Rubber (JSR) of Tokyo, Japan; BUNA CB 21, CB 22, CB 23, CB 24, CB 25, CB 29 IVIES, CB 60, CB Nd 60, CB 55 NF, CB 70 B, CB KA 8967, and CB 1221, available from Lanxess Corp. of Pittsburgh, Pa.; BR1208, available from LG Chemical of Seoul, South Korea; UBEPOL BR130B, BR150, BR150B, BR150L, BR230, BR360L, BR710, and VCR617, available from UBE Industries, Ltd. of Tokyo, Japan; EUROPRENE NEOCIS BR 60, INTENE 60 AF and P30AF, and EUROPRENE BR HV80, available from Polimeri Europa of Rome, Italy; KBR 01, NdBr 40, NdBR-45, NdBr 60, KBR 710S, KBR 710H, and KBR 750, available from Kumho Petrochemical Co., Ltd. Of Seoul, South Korea; DIENE 55NF, 70AC, and 320 AC, available from Firestone Polymers of Akron, Ohio; and PBR-Nd Group II and Group III, available from Nizhnekamskneftekhim, Inc. of Nizhnekamsk, Tartarstan Republic.

In another embodiment, the core composition includes butyl rubber. Butyl rubber is synthetic polymer made by polymerizing isobutylene and isoprene. Butyl rubber is an amorphous, non-polar polymer with good oxidative and thermal stability, good permanent flexibility and high moisture and gas resistance. Generally, butyl rubber includes copolymers of about 70 percent to about 99.5 percent by weight of an isoolefin, which has about 4 to 7 carbon atoms, for example, isobutylene, and about 0.5 percent to about 30 percent by weight of a conjugated multiolefin, which has about 4 to 14 carbon atoms, for example, isoprene. The resulting copolymer contains about 85 percent to about 99.8 percent by weight of combined isoolefin and about 0.2 percent to about 15 percent of combined multiolefin. A non-limiting example of a commercially available butyl rubber includes Bayer Butyl 301 manufactured by Bayer AG.

In still another embodiment, the core composition used to form the core includes a blend of polybutadiene and butyl rubber. In this embodiment, the core composition may include a blend of polybutadiene and butyl rubber in a ratio of about 10:90 to about 90:10. For example, the core composition may include a blend of polybutadiene and butyl rubber in a ratio of about 10:90 to about 90:10 or about 20:80 to about 80:20 or about 30:70 to about 70:30 or about 40:60 to about 60:40. In other embodiments, the core composition may include polybutadiene and/or butyl rubber in a blend with any of the other elastomers discussed above.

The resiliency additive discussed above may be included in the core composition in varying amounts depending on the desired characteristics of the golf ball core. Generally, changes to a golf ball core that affect the resiliency of a golf ball core also affect the compression of the golf ball core. For example, changes to the golf ball core that increase the CoR of the golf ball core may also increase the compression of the golf ball core, and changes to the golf ball core that decrease the CoR of the golf ball core may also decrease the compression of the golf ball core. However, a resiliency additive used in accordance with the present disclosure may allow the CoR of the golf ball core to be manipulated independently from the compression of the golf ball core or with minimal effect on the compression of the golf ball core.

In some embodiments, the resiliency additive may be used in an amount of about 1 to about 50 parts by weight per 100 parts of the total rubber. In one embodiment, the core composition of the core includes about 1 to about 25 or about 1 to about 10 or about 5 to about 15 parts by weight resiliency additive per 100 parts of the total rubber. In another embodiment, the resiliency additive is included in the core composition in an amount of about 10 to about 30 or about 13 to about 23 or about 17 to about 27 parts by weight per 100 parts of the total rubber. In yet another embodiment, the core composition includes about 25 to about 45 or about 27 to about 37 or about 33 to about 43 parts by weight resiliency additive per 100 parts of the total rubber.

The core compositions further include a reactive cross-linking co-agent. Suitable co-agents include, but are not limited to, metal salts of unsaturated carboxylic acids having from 3 to 8 carbon atoms; unsaturated vinyl compounds and polyfunctional monomers (e.g., trimethylolpropane trimethacrylate); phenylene bismaleimide; and combinations thereof. In one embodiment, the co-agent is one or more metal salts of acrylates, diacrylates, methacrylates, and dimethacrylates, wherein the metal is selected from magnesium, calcium, zinc, aluminum, lithium, and nickel. In another embodiment, the co-agent includes one or more zinc salts of acrylates, diacrylates, methacrylates, and dimethacrylates. For example, the co-agent may be zinc diacrylate (ZDA). In another embodiment, the co-agent may be zinc dimethacrylate (ZDMA). A non-limiting example of a commercially available zinc diacrylate includes Dymalink® 526 manufactured by Cray Valley.

The co-agent may be included in the core composition in varying amounts depending on the desired characteristics of the golf ball core. For example, the co-agent may be used in an amount of about 10 to about 50 parts by weight per 100 parts of the total rubber. In one embodiment, the core composition includes about 15 to about 40 parts by weight co-agent per 100 parts of the total rubber. In another embodiment, the core composition includes about 20 to about 35 or about 22 to about 30 parts by weight co-agent per 100 parts of total rubber. In still another embodiment, the core composition includes about 23 to about 27 or about 25 to about 29 parts by weight co-agent per 100 parts of the total rubber. Without being bound to any particular theory, increasing the concentration of co-agent in the core composition of a golf ball core increases the compression and CoR of a golf ball core.

Radical scavengers such as a halogenated organosulfur, organic disulfide, or inorganic disulfide compounds may also be added to the core composition. In one embodiment, a halogenated organosulfur compound included in the core composition includes, but is not limited to, pentachlorothiophenol (PCTP) and salts of PCTP such as zinc pentachlorothiophenol (Zn-PCTP). In another embodiment, ditolyl disulfide, diphenyl disulfide, dixylyl disulfide, 2-nitroresorcinol, and combinations thereof are added to the core composition. A non-limiting example of a commercially available radical scavenger includes Rhenogran® Zn-PTCP-72 manufactured by Rheine Chemie. The radical scavenger may be included in the core composition in an amount of about 0.1 to about 1 part by weight per 100 parts of the total rubber. In one embodiment, the core composition may include about 0.3 to about 0.8 parts by weight radical scavenger compound per 100 parts of the total rubber. In another embodiment, the core composition may include about 0.2 to about 0.5 or about 0.4 to about 0.6 or about 0.5 to about 0.8 parts by weight radical scavenger compound per 100 parts of the total rubber.

The core composition may also include filler(s). Suitable non-limiting examples of fillers include carbon black, clay and nanoclay particles, talc, glass (e.g., glass flake, milled glass, and microglass), mica and mica-based pigments (e.g., Iriodin® pearl luster pigments from The Merck Group), and combinations thereof. Metal oxide and metal sulfate fillers are also contemplated for inclusion in the core composition. Suitable metal fillers include, for example, particulate, powders, flakes, and fibers of copper, steel, brass, tungsten, titanium, aluminum, magnesium, molybdenum, cobalt, nickel, iron, lead, tin, zinc, barium, bismuth, bronze, silver, gold, and platinum, and alloys and combinations thereof. Suitable metal oxide fillers include, for example, zinc oxide, iron oxide, aluminum oxide, titanium oxide, magnesium oxide, and zirconium oxide. Suitable metal sulfate fillers include, for example, barium sulfate and strontium sulfate.

When included, the fillers may be in an amount of about 1 to about 40 parts by weight per 100 parts of the total rubber. In one embodiment, the core composition includes at least one filler in an amount of about 1 to about 15 or about 3 to about 10 parts by weight per 100 parts of the total rubber. In another embodiment, the core composition includes at least one filler in an amount of about 3 to about 7 or about 5 to about 9 or about 5 to about 7 parts by weight per 100 parts of the total rubber. In yet another embodiment, the core composition includes at least one filler in an amount of about 1 to about 30 or about 5 to about 25 or about 10 to about 20 parts by weight per 100 parts of the total rubber. In a further embodiment, the core composition includes at least one filler in an amount of about 12 to about 17 or about 13 to about 18 or about 14 to about 16 parts by weight per 100 parts of the total rubber. A non-limiting example of a commercially available filler suitable for use in accordance with the present disclosure includes PolyWate® 325 manufactured by Cimbar Performance Minerals.

In some embodiments, more than one type of filler may be included in the core composition. For example, in one embodiment, the core composition may include a first filler in an amount from about 1 to about 15 or about 2 to about 12 parts by weight per 100 parts total rubber and a second filler in an amount from about 1 to about 30 or about 7 to about 22 parts by weight per 100 parts total rubber. In another embodiment, the core composition may include a first filler in an amount from about 3 to about 10 or about 4 to about 8 parts by weight per 100 parts total rubber and a second filler in an amount from about 11 to about 19 or about 13 to about 17 parts by weight per 100 parts total rubber. In yet another embodiment, the core composition may include a first filler in an amount from about 2 to about 6 or about 4 to about 8 parts by weight per 100 parts total rubber and a second filler in an amount from about 11 to about 16 or about 14 to about 19 parts by weight per 100 parts total rubber.

Antioxidants, processing aids, accelerators (for example, tetra methylthiuram), dyes and pigments, wetting agents, surfactants, plasticizers, coloring agents, fluorescent agents, chemical blowing agents, foaming agents, defoaming agents, stabilizers, softening agents, impact modifiers, antiozonants, as well as other additives known in the art, may also be added to the core composition. Examples of suitable processing aids include, but are not limited to, high molecular weight organic acids and salts thereof. Suitable organic acids are aliphatic organic acids, aromatic organic acids, saturated mono-functional organic acids, unsaturated mono-functional organic acids, multi-unsaturated mono-functional organic acids, and dimerized derivatives thereof. In one embodiment, the organic acids include, but are not limited to, caproic acid, caprylic acid, capric acid, lauric acid, stearic acid, behenic acid, erucic acid, oleic acid, linoleic acid, myristic acid, benzoic acid, palmitic acid, phenylacetic acid, naphthalenoic acid, and dimerized derivatives thereof. The salts of organic acids include the salts of barium, lithium, sodium, zinc, bismuth, chromium, cobalt, copper, potassium, strontium, titanium, tungsten, magnesium, cesium, iron, nickel, silver, aluminum, tin, or calcium, salts of fatty acids, particularly stearic, behenic, erucic, oleic, linoelic or dimerized derivatives thereof.

The core composition may be cured using conventional curing processes. Non-limiting examples of curing processes suitable for use in accordance with the present disclosure include peroxide-curing, sulfur-curing, high-energy radiation, and combinations thereof. In one embodiment, the core composition includes a free-radical initiator selected from organic peroxides, high energy radiation sources capable of generating free-radicals, and combinations thereof. Suitable organic peroxides include, but are not limited to, dicumyl peroxide; n-butyl-4,4-di(t-butylperoxy) valerate; 1,1-di(t-butylperoxy)3,3,5-trimethylcyclohexane; 2,5-dimethyl-2,5-di(t-butylperoxy) hexane; di-t-butyl peroxide; di-t-amyl peroxide; t-butyl peroxide; t-butyl cumyl peroxide; 2,5-dimethyl-2,5-di(t-butylperoxy)hexyne-3; di(2-t-butyl-peroxyisopropyl)benzene; dilauroyl peroxide; dibenzoyl peroxide; t-butyl hydroperoxide; and combinations thereof. In a particular embodiment, the free radical initiator is dicumyl peroxide, including, but not limited to Perkadox® BC, commercially available from Akzo Nobel. Peroxide free-radical initiators may be present in the core composition in an amount of at least 0.05 parts by weight per 100 parts of the total rubber, or an amount within the range having a lower limit of 0.05 parts or 0.1 parts or 1 part or 1.25 parts or 1.5 parts or 2.5 parts or 5 parts by weight per 100 parts of the total rubber, and an upper limit of 2.5 parts or 3 parts or 5 parts or 6 parts or 10 parts or 15 parts by weight per 100 parts of the total rubber. For example, the core composition may include peroxide free-radical initiators in an amount of about 0.1 to about 2.5 or about 0.3 to about 1.8 or about 0.5 to about 1.2 parts by weight per 100 parts of the total rubber. In another example, the core composition may include peroxide free-radical initiators in an amount of about 0.5 to about 0.9 or about 0.7 to about 1.2 or about 0.6 to about 1.0 or about 0.7 to about 0.9 parts by weight per 100 parts of the total rubber.

Cover Compositions

In contrast to the core, the cover of a golf ball plays less of a role on shots made with a driver. However, because the cover plays a large role in generating spin on iron and wedge shots, the cover material and properties are still important in determining the performance of the finished golf ball. In this aspect, different materials may be used in the construction of the intermediate and cover layers of golf balls according to the present disclosure. Among other things, the resiliency of conventional golf balls is constrained by available materials typically used in golf ball covers, such as ionomers and polyurethanes. These materials typically have a low CoR and cannot easily be tailored to produce a cover with a desired CoR. As discussed in more detail below, one or more of the layers of the cover may include a cover formed from a composition including a resiliency additive to produce a cover having a tailored or desired CoR.

In some embodiments, the resiliency additive is included in the cover composition in an amount of about 5 percent to 100 percent by weight based on the total weight of the cover composition. In one embodiment, the resiliency additive is included in the cover composition in an amount within a range having a lower limit of about 5 percent or 10 percent or 20 percent or 30 percent or 40 percent or 50 percent and an upper limit of about 50 percent or 60 percent or 70 percent or 80 percent or 90 percent or 95 percent or 100 percent. For example, the resiliency additive may be present in the cover composition in an amount of about 5 percent to about 95 percent or about 10 percent to about 90 percent or about 20 percent to about 80 percent or about percent to about 70 percent or about 40 percent to about 60 percent by weight resiliency additive based on the total weight of the cover composition. In another example, the cover composition includes about 10 percent to about 70 percent or about 20 percent to about 60 percent or about 30 percent to about 50 percent or about 10 percent to about 40 percent or about 40 percent to about 70 percent or about 10 percent to about 30 percent or about 50 percent to about 70 percent by weight resiliency additive based on the total weight of the cover composition. In a further example, the cover composition may include about 30 percent to about 90 percent or about 40 percent to about 80 percent or about 50 percent to about 70 percent or about 30 percent to about 70 percent or about 50 percent to about 90 percent or about 30 percent to about 50 percent or about 70 percent to about 90 percent by weight resiliency additive based on the total weight of the cover composition. In one embodiment, the cover is formed entirely from the resiliency additive.

In other embodiments, the resiliency additive may be included in the cover composition along with one or more other components. For example, the cover composition may also include a base polymer. In some embodiments, the base polymer may be present in the cover composition in an amount of about 5 percent to about 95 percent or about 10 percent to about 90 percent or about 20 percent to about 80 percent or about 30 percent to about 70 percent or about 40 percent to about 60 percent by weight resiliency additive based on the total weight of the cover composition. In another example, the cover composition includes about 10 percent to about 70 percent or about 20 percent to about 60 percent or about 30 percent to about 50 percent or about 10 percent to about 50 percent or about 30 percent to about 70 percent or about 10 percent to about 30 percent or about 50 percent to about 70 percent by weight base polymer based on the total weight of the cover composition. In a further example, the cover composition may include about 30 percent to about 90 percent or about 40 percent to about 80 percent or about 50 percent to about 70 percent or about 60 percent to about 90 percent or about 30 percent to about 60 percent or about 30 percent to about 50 percent or about 70 percent to about 90 percent by weight base polymer based on the total weight of the cover composition. In some embodiments, the cover may include a blend of two or more base polymers.

The base polymer may be a variety of materials depending on the desired characteristics and performance of a golf ball having a cover formed from a cover composition as described herein, e.g., including a base polymer and a resiliency additive. Examples of materials suitable for use as the base polymer include, but are not limited to, polyurethanes; polyureas; copolymers, blends and hybrids of polyurethane and polyurea; olefin-based copolymer ionomer resins; polyethylene, including, for example, low density polyethylene, linear low density polyethylene, and high density polyethylene; polypropylene; rubber-toughened olefin polymers; acid copolymers, for example, poly(meth)

acrylic acid, which do not become part of an ionomeric copolymer; plastomers; flexomers; styrene/butadiene/styrene block copolymers; styrene/ethylene-butylene/styrene block copolymers; dynamically vulcanized elastomers; copolymers of ethylene and vinyl acetates; copolymers of ethylene and methyl acrylates; polyvinyl chloride resins; polyamides, poly(amide-ester) elastomers, and graft copolymers of ionomer; cross-linked trans-polyisoprene and blends thereof; polyester-based thermoplastic elastomers; polyurethane-based thermoplastic elastomers; synthetic or natural vulcanized rubber; and combinations thereof.

In other embodiments, the base polymer is a polyurethane, polyurea, or hybrid of polyurethane-polyurea. When used as cover layer materials, polyurethanes and polyureas can be thermoset or thermoplastic. Thermoset materials can be formed into golf ball layers by conventional casting or reaction injection molding techniques. Thermoplastic materials can be formed into golf ball layers by conventional compression or injection molding techniques. Generally, cover layers made from polyurethane, polyurea, or hybrids of polyurethane-polyurea have a low resilience. Without being bound to any particular theory, including the resiliency additive in a cover layer formed from polyurethane, polyurea, or hybrid of polyurethane-polyurea may allow for the resiliency of the cover layer to be increased or tailored to a desired core value.

In further embodiments, the base polymer may include conventional and non-conventional materials. For example, the base polymer may include materials such as, for instance, ionomer resins, highly neutralized polymers, polybutadiene, butyl rubber, and other rubber-based core formulations, and the like. In one embodiment, the inner cover layer includes an ionomer. In this aspect, ionomers suitable for use in accordance with the present disclosure may include partially-neutralized ionomers and highly-neutralized ionomers (HNPs), including ionomers formed from blends of two or more partially-neutralized ionomers, blends of two or more highly-neutralized ionomers, and blends of one or more partially-neutralized ionomers with one or more highly-neutralized ionomers. For purposes of the present disclosure, "HNP" refers to an acid copolymer after at least 70 percent of all acid groups present in the composition are neutralized.

Preferred ionomers are salts of O/X- and O/X/Y-type acid copolymers, wherein O is an α-olefin, X is a $C_3$-$C_8$ α, β-ethylenically unsaturated carboxylic acid, and Y is a softening monomer. O is preferably selected from ethylene and propylene. X is preferably selected from methacrylic acid, acrylic acid, ethacrylic acid, crotonic acid, and itaconic acid. Methacrylic acid and acrylic acid are particularly preferred. Y is preferably selected from (meth) acrylate and alkyl (meth) acrylates wherein the alkyl groups have from 1 to 8 carbon atoms, including, but not limited to, n-butyl (meth) acrylate, isobutyl (meth) acrylate, methyl (meth) acrylate, and ethyl (meth) acrylate.

Preferred O/X and O/X/Y-type copolymers include, without limitation, ethylene acid copolymers, such as ethylene/(meth)acrylic acid, ethylene/(meth)acrylic acid/maleic anhydride, ethylene/(meth)acrylic acid/maleic acid mono-ester, ethylene/maleic acid, ethylene/maleic acid mono-ester, ethylene/(meth)acrylic acid/n-butyl (meth)acrylate, ethylene/(meth)acrylic acid/isobutyl (meth)acrylate, ethylene/(meth)acrylic acid/methyl (meth)acrylate, ethylene/(meth) acrylic acid/ethyl (meth)acrylate terpolymers, and the like. The term, "copolymer," as used herein, includes polymers having two types of monomers, those having three types of monomers, and those having more than three types of monomers. Preferred α, B-ethylenically unsaturated mono- or dicarboxylic acids are (meth) acrylic acid, ethacrylic acid, maleic acid, crotonic acid, fumaric acid, itaconic acid. (Meth) acrylic acid is most preferred. As used herein, "(meth) acrylic acid" means methacrylic acid and/or acrylic acid. Likewise, "(meth) acrylate" means methacrylate and/or acrylate.

In a particularly preferred version, highly neutralized E/X- and E/X/Y-type acid copolymers, wherein E is ethylene, X is a $C_3$-$C_8$ α, β-ethylenically unsaturated carboxylic acid, and Y is a softening monomer are used. X is preferably selected from methacrylic acid, acrylic acid, ethacrylic acid, crotonic acid, and itaconic acid. Methacrylic acid and acrylic acid are particularly preferred. Y is preferably an acrylate selected from alkyl acrylates and aryl acrylates and preferably selected from (meth) acrylate and alkyl (meth) acrylates wherein the alkyl groups have from 1 to 8 carbon atoms, including, but not limited to, n-butyl (meth) acrylate, isobutyl (meth) acrylate, methyl (meth) acrylate, and ethyl (meth) acrylate. Preferred E/X/Y-type copolymers are those wherein X is (meth) acrylic acid and/or Y is selected from (meth) acrylate, n-butyl (meth) acrylate, isobutyl (meth) acrylate, methyl (meth) acrylate, and ethyl (meth) acrylate. More preferred E/X/Y-type copolymers are ethylene/(meth) acrylic acid/n-butyl acrylate, ethylene/(meth) acrylic acid/methyl acrylate, and ethylene/(meth) acrylic acid/ethyl acrylate.

The amount of ethylene in the acid copolymer may be at least about 15 weight percent, at least about 25 weight percent, at least about 40 weight percent, or at least about 60 weight percent, based on total weight of the copolymer. The amount of $C_3$ to $C_8$ α, β-ethylenically unsaturated mono- or dicarboxylic acid in the acid copolymer is typically from 1 weight percent to 35 weight percent, from 5 weight percent to 30 weight percent, from 5 weight percent to 25 weight percent, or from 10 weight percent to 20 weight percent, based on total weight of the copolymer. The amount of optional softening comonomer in the acid copolymer may be from 0 weight percent to 50 weight percent, from 5 weight percent to 40 weight percent, from 10 weight percent to 35 weight percent, or from 20 weight percent to 30 weight percent, based on total weight of the copolymer.

The various O/X, E/X, O/X/Y, and E/X/Y-type copolymers are at least partially neutralized with a cation source, optionally in the presence of a high molecular weight organic acid, such as those disclosed in U.S. Pat. No. 6,756,436, the entire disclosure of which is hereby incorporated herein by reference. The acid copolymer can be reacted with the optional high molecular weight organic acid and the cation source simultaneously, or prior to the addition of the cation source. Suitable cation sources include, but are not limited to, metal ion sources, such as compounds of alkali metals, alkaline earth metals, transition metals, and rare earth elements; ammonium salts and monoamine salts; and combinations thereof. Preferred cation sources are compounds of magnesium, sodium, potassium, cesium, calcium, barium, manganese, copper, zinc, lead, tin, aluminum, nickel, chromium, lithium, and rare earth metals. The amount of cation used in the composition is readily determined based on desired level of neutralization. As discussed above, for HNP compositions, the acid groups are neutralized to 70 percent or greater, 70 to 100 percent, or 90 to 100 percent. In one embodiment, an excess amount of neutralizing agent, that is, an amount greater than the stoichiometric amount needed to neutralize the acid groups, may be used. That is, the acid groups may be neutralized to 100 percent or greater, for example 110 percent or 120 percent or greater. In other embodiments, partially-neutralized compositions are prepared, wherein 10 percent or greater, normally 30 percent or greater of the acid groups are neutralized. When aluminum is used as the cation source, it is preferably used at low levels with another cation such as zinc, sodium, or lithium, since aluminum has a dramatic effect on melt flow reduction and cannot be used alone at high levels. For example, aluminum is used to neutralize about 10 percent of the acid groups and sodium is added to neutralize an additional 90 percent of the acid groups.

"Low acid" and "high acid" ionomeric polymers, as well as blends of such ionomers, may be used. In general, low acid ionomers are considered to be those containing 16 weight percent or less of acid moieties, whereas high acid ionomers are considered to be those containing greater than 16 weight percent of acid moieties. In one embodiment, the inner cover layer is formed from a composition including a high acid ionomer. A suitable high acid ionomer is Surlyn® 8150 (Dow), which is a copolymer of ethylene and methacrylic acid, having an acid content of 19 weight percent, 45 percent neutralized with sodium. In another embodiment, the inner cover layer is formed from a composition including a high acid ionomer and a maleic anhydride-grafted non-ionomeric polymer. An example of a suitable maleic anhydride-grafted polymer is Fusabond® 525D (Dow), which is a maleic anhydride-grafted, metallocene-catalyzed ethylene-butene copolymer having about 0.9 weight percent maleic anhydride grafted onto the copolymer. Blends of high acid ionomers with maleic anhydride-grafted polymers are further disclosed, for example, in U.S. Pat. Nos. 6,992,135 and 6,677,401, the entire disclosures of which are hereby incorporated herein by reference.

When used to form the inner cover layer, the base polymer may include a 50/45/5 blend of Surlyn® 8940/Surlyn® 9150/Nucrel ° 960. In this aspect, the composition may have a material hardness of from 80 to 85 Shore C. In another embodiment, the inner cover layer is formed from a composition including a 50/25/25 blend of Surlyn® 8940/Surlyn® 9150/Surlyn® 9910, having a material hardness of about 85 to 95 Shore C. In yet another embodiment, the inner cover layer is formed from a composition including a 50/50 blend of Surlyn® 8940/Surlyn® 9150, having a material hardness of about 82 to 90 Shore C. A composition including a 50/50 blend of Surlyn® 8940 and Surlyn® 7940 also may be used.

The cover composition may also contain a variety of fillers and additives to impart specific properties to the ball. For example, relatively heavy-weight and light-weight metal fillers such as, particulate; powders; flakes; and fibers of copper, steel, brass, tungsten, titanium, aluminum, magnesium, molybdenum, cobalt, nickel, iron, lead, tin, zinc, barium, bismuth, bronze, silver, gold, and platinum, and alloys and combinations thereof may be used to adjust the specific gravity of the ball. Other additives and fillers include, but are not limited to, optical brighteners, coloring agents, fluorescent agents, whitening agents, UV absorbers, light stabilizers, surfactants, processing aids, antioxidants, stabilizers, softening agents, fragrance components, plasticizers, impact modifiers, titanium dioxide, clay, mica, talc, glass flakes, milled glass, and mixtures thereof Core Properties The properties of a golf ball core (or components of the core) formed with the core composition of the present disclosure are discussed below.

Hardness

The hardness of the geometric center of the core may be obtained according to the following: the core is first gently pressed into a hemispherical holder having an internal diameter approximately slightly smaller than the diameter of the core, such that the core is held in place in the hemispherical portion of the holder while concurrently leaving the geometric central plane of the center exposed. The core is secured in the holder by friction, such that it will not move during the cutting and grinding steps, but the friction is not so excessive that distortion of the natural shape of the core would result. The core is secured such that the parting line of the center is roughly parallel to the top of the holder. The diameter of the center is measured 90 degrees to this orientation prior to securing. A measurement is also made from the bottom of the holder to the top of the core to provide a reference point for future calculations. A rough cut is made slightly above the exposed geometric center of the core using a band saw or other appropriate cutting tool, making sure that the core does not move in the holder during this step. The remainder of the core, still in the holder, is secured to the base plate of a surface grinding machine. The exposed 'rough' surface is ground to a smooth, flat surface, revealing the geometric center of the core, which can be verified by measuring the height from the bottom of the holder to the exposed surface of the core, making sure that exactly half of the original height of the core, as measured above, has been removed to within 0.004 inches. Leaving the core in the holder, the geometric center of the core is confirmed with a center square and carefully marked, and the hardness is measured at the center mark according to ASTM D-2240.

Additional hardness measurements at any distance from the geometric center of the core can then be made by drawing a line radially outward from the geometric center mark and measuring the hardness at any given distance along the line, typically in 2 mm increments from the center of the core. The hardness at a particular distance from the geometric center should be measured along at least two, preferably four, radial arms located 180° apart, or 90° apart, respectively, and then averaged. All hardness measurements performed on a plane passing through the geometric center are performed while the core is still in the holder and without having disturbed its orientation, such that the test surface is constantly parallel to the bottom of the holder, and thus also parallel to the properly aligned foot of the durometer.

The outer surface hardness of the core (or any golf ball layer) is measured on the actual outer surface of the layer and is obtained from the average of a number of measurements taken from opposing hemispheres, taking care to avoid making measurements on the parting line of the core or on surface defects, such as holes or protrusions and preferably making the measurements prior to surrounding the layer of interest with an additional layer. Hardness measurements are made pursuant to ASTM D-2240 "Indentation Hardness of Rubber and Plastic by Means of a Durometer." Because of the curved surface, care must be taken to ensure that the golf ball or golf ball sub-assembly is centered under the durometer indenter before a surface hardness reading is obtained. A calibrated, digital durometer, capable of reading to 0.1 hardness units is used for the hardness measurements. The digital durometer must be attached to, and its foot made parallel to, the base of an automatic stand. The weight on the durometer and attack rate conforms to ASTM D-2240. It is worthwhile to note that, once an additional layer surrounds a layer of interest, the hardness of the layer of interest can be difficult to determine. Therefore, for purposes of the present disclosure, when the hardness of a layer is needed after the inner layer has been surrounded with another layer, the test procedure for measuring a point located 1 mm from an interface is used.

It should also be noted that there is a fundamental difference between "material hardness" and "hardness as measured directly on a golf ball" (or, as used herein, "surface hardness"). For purposes of the present disclosure, material hardness is measured according to ASTM D2240 and generally involves measuring the hardness of a flat "slab" or "button" formed of the material. Surface hardness as measured directly on a golf ball (or other spherical surface) typically results in a different hardness value. The difference in "surface hardness" and "material hardness" values is due to several factors including, but not limited to, ball construction (that is, core type, number of layers, and the like); ball (or ball sub-assembly) diameter; and the material composition of adjacent layers. It also should be understood that the two measurement techniques are not linearly related and, therefore, one hardness value cannot easily be correlated to the other. Shore hardness (for example, Shore C or Shore D hardness) was measured according to the test method ASTM D-2240.

A golf ball core made from the core composition of the present disclosure may have a hardness at the geometric center of the core, referred to herein as $H_C$, that ranges from about 30 to about 70 Shore C or about 40 to about 60 Shore C. In one embodiment, the core has a hardness at its geometric center of about 45 to about 60 Shore C or about 48 to about 56 Shore C or about 51 to about 54 Shore C. In another embodiment, the core has a hardness at its geometric center of about 52 to about 68 Shore C or about 55 to about 64 Shore C or about 58 to about 61 Shore C. In yet another embodiment, the core has a hardness at its geometric center of about 51 to about 66 Shore C or about 54 to about 63 Shore C or about 57 to about 60 Shore C. In a further embodiment, the core has a hardness at its geometric center of about 35 to about 50 Shore C or about 37 to about 43 Shore C or about 39 to about 45 Shore C or about 42 to about 48 Shore C.

The hardness at the surface of the core may range from about 70 to about 95 Shore C or about 75 to about 90 Shore C. In one embodiment, the hardness at the surface of the core is about 75 to about 85 Shore C or about 77 to about 83 Shore C or about 79 to about 81 Shore C. In another embodiment, the hardness at the surface of the core is about 76 to about 86 Shore C or about 78 to about 84 Shore C or about 80 to about 82 Shore C. In yet another embodiment, the hardness at the surface of the core is about 77 to about 88 Shore C or about 79 to about 86 Shore C or about 81 to about 84 Shore C.

The direction of the hardness gradient is defined by the difference in hardness measurements taken at the geometric center and outer surfaces of the core. The geometric center hardness is readily determined according to the test procedures provided above. For example, the hardness of the outer surface of the core is also readily determined according to the procedures given herein for measuring the outer surface hardness of a golf ball layer, if the measurement is made prior to surrounding the core with additional layers.

While the hardness gradient across the core will vary based on several factors including, but not limited to, the dimensions and formulations of the components, the core of the present disclosure may have a "zero" hardness gradient or a "positive" hardness gradient (that is, the geometric center is softer than the outer surface of the core). More particularly, the term, "zero hardness gradient" as used herein means a hardness gradient of less than about 3 Shore C, preferably less than about 1 Shore C and may have a value of zero. The term, "positive hardness gradient" as used herein means a hardness gradient of positive about 2 Shore C or greater, about 4 Shore C or greater, about 6 Shore C or greater, about 8 Shore C or greater, or about 10 Shore C or greater. In general, the hardness gradient may be determined by subtracting the hardness value of the first component being measured (for example, the geometric center of the core) from the hardness value of the second component being measured (for example, the outer surface of the core).

The core of the present disclosure may have a zero or positive hardness gradient. In one embodiment, the core has a hardness gradient from the geometric center to the surface of the core of about 0 to about 42 Shore C or about 10 to about 42 Shore C or about 15 to about 35 Shore C or about 15 to about 30 Shore C. In another embodiment, the core may have a hardness gradient of about 0 to about 20 Shore C or about 5 to about 15 Shore C or about 0 to about 10 Shore C or about 0 to about 5 Shore C. In this aspect, the core may have a zero hardness gradient of about 0 to about 3 Shore C or about 0 to about 1 Shore C. In another embodiment, the core has a positive hardness gradient of about 20 to about 30 Shore C or about 16 to about 28 Shore C or about 18 to about 26 Shore C or about 20 to about 24 Shore C. In still another embodiment, the positive hardness gradient of the core is about 18 to about 32 Shore C or about 20 to about 28 Shore C or about 23 to about 26 Shore C. In yet another embodiment, the positive hardness gradient of the core may be about 21 to about 36 Shore C or about 24 to about 32 Shore C or about 26 to 30 Shore C. In a further embodiment, the positive hardness gradient of the core is about 28 to about 42 Shore C or about 30 to about 39 for Shore C or about 33 to about 37 Shore C.

In some embodiments, the core may be a dual layer core including an inner core layer and an outer core layer. The inner core layer has a geometric center hardness that ranges from about 45 to about 65 Shore C. In one embodiment, the hardness at the geometric center of the inner core layer is about 50 to about 60 Shore C. For example, the inner core layer may have a hardness at its geometric center of about 52 to about 56 Shore C or about 54 to about 58 Shore C. The hardness at the surface of the inner core layer may range from about 70 to about 90 Shore C. In one embodiment, the hardness at the surface of the inner core layer is about 70 to about 85 Shore C or about 70 to about 80 Shore C or about 75 to about 85 Shore C. In another example, the inner core layer may have a surface hardness of about 78 to about 82 Shore C.

The outer layer of the dual layer core has an outer surface hardness that may range from about 80 to about 100 Shore C. For example, the outer layer may have an outer surface hardness of about 85 to about 100 Shore C or about 85 to about 95 Shore C or about 88 to about 92 Shore C. In another example, the outer layer has an outer surface hardness of about 90 to about 100 Shore C or about 93 to about 97 Shore C.

Dual layer core embodiments may also have an overall core gradient, i.e., the hardness gradient from the center of the inner core to the outer surface of the outer core layer. Generally, the geometric hardness of the center is less than the surface hardness of the outer core layer. The overall core gradient may be about 25 Shore C or greater or about 30 Shore C or greater. In one embodiment, the positive hardness gradient from the geometric center to the surface of the outer core layer is in the range of about 30 to about 50 Shore C or about 30 to 45 Shore C or about 35 to 50 Shore C or about 37 to about 43 Shore C. For example, the overall core gradient may be about 30 to 40 Shore C or 33 to about 37 Shore C or about 31 to about 36 Shore C or about 34 to about 39 Shore C. In another example, the overall core gradient may be about 40 to 50 Shore C or 43 to about 47 Shore C or about 41 to about 46 Shore C or about 44 to about 49 Shore C.

The center itself may also have a positive hardness gradient. In one embodiment, the center has a positive hardness gradient from the geometric center to the surface of the center of about 10 to 40 Shore C. In this aspect, the positive hardness gradient of the center (from the geometric center to the surface of the center) is about 15 to about 35 Shore C. For example, the positive hardness gradient of the center is about 20 to about 28 Shore C. The center may also have a "zero" hardness gradient, i.e., the hardness values of the outer surface of the outer core layer and the geometric center are substantially the same. In other embodiments, the outer core layer may have a "zero" hardness gradient within the layer itself (i.e., the hardness values of the inner surface and outer surface of the outer core layer are substantially the same). In still other embodiments, the surface of the center and the inner surface of the outer core layer may have a substantially similar hardness or the same hardness, but the surface of the center and the outer surface of the outer core layer still have hardness values that differ such that a positive hardness gradient as described above is achieved.

In some embodiments, a point or plurality of points measured along a "positive" gradient may be above or below a line fit through the gradient and its outermost and innermost hardness values. In an alternative embodiment, the hardest point along a particular steep "positive" gradient may be higher than the value at the innermost portion of the center (the geometric center) or outer surface of the core—as long as the outermost point (i.e., the outer surface of the core) is greater than the innermost point (i.e., the geometric center of the core), such that the "positive" gradients remain intact.

Compression

Several different methods can be used to measure compression, including Atti compression, Riehle compression, load/deflection measurements at a variety of fixed loads and offsets, and effective modulus (see, e.g., Compression by Any Other Name, Science and Golf IV, Proceedings of the World Scientific Congress of Golf (Eric Thain ed., Routledge, 2002) (J. Dalton). For purposes of the present disclosure, compression values are provided as measured by the Dynamic Compression Machine ("DCM") as well as the Soft Center Deflection Index ("SCDI"). The DCM applies a load to a ball component or a ball and measures the number of inches the core or ball is deflected at measured loads. A crude load/deflection curve is generated that is fit to the Atti compression scale that results in a number being generated that represents an Atti compression. The DCM does this via a load cell attached to the bottom of a hydraulic cylinder that is triggered pneumatically at a fixed rate (typically about 1.0 ft/s) towards a stationary core. Attached to the cylinder is an LVDT that measures the distance the cylinder travels during the testing timeframe. A software-based logarithmic algorithm ensures that measurements are not taken until at least five successive increases in load are detected during the initial phase of the test.

The SCDI is a slight variation of the DCM set up that allows determination of the pounds required to deflect a component or ball 10 percent of its diameter. With the SCDI, the goal is to obtain the pounds of force required to deflect a component or ball a certain amount of inches. That amount of deflection is 10 percent of the component or ball diameter. The DCM is triggered, the cylinder deflects the component or ball by 10 percent of its diameter, and the DCM reports back the pounds of force required (as measured from the attached load cell) to deflect the component or ball by that amount. The SCDI value obtained is a single number in units of pounds.

The compression of a core made from the core composition of the present disclosure may range from about 25 to about 90 DCM. For example, the core compression may be about 30 to about 85 DCM or about 40 to about 80 DCM or about 45 to about 75 DCM. In another example, the core compression may range from about 25 to about 70 DCM or about 30 to about 65 DCM or about 35 to about 60 DCM or about 40 to about 55 DCM or about 30 to about 50 DCM or about 45 to about 65 DCM. In a further example the core compression is about 25 to about 35 DCM or about 33 to about 43 DCM or about 41 to about 51 DCM or about 49 to about 59 DCM or about 57 to about 67 DCM or about 65 to about 75 DCM. In yet another example, the core compression is about 70 to about 90 DCM or about 70 to about 80 DCM or about 71 to about 77 DCM.

Diameter

The diameter of the core may vary. In some embodiments, the core diameter may range from about 1.5 to about 1.630 inches. For example, the core may have a diameter of 1.53 to 1.620 inches. In embodiments where the core includes two or more layers, the diameter of the inner layer of the core may range from about 1.0 to about 1.4 inches or from about 1.0 to about 1.2 inches.

Coefficient of Restitution

The golf ball cores of the present disclosure may be tailored to have a desired and/or targeted Coefficient of Restitution (CoR) value. In some cases, it may be desirable to produce a golf ball core having a relatively high CoR value. In one embodiment, the CoR of a golf ball core made from the core composition of the present disclosure at 125 ft/s is about 0.740 or greater, or about 0.750 or greater, or about 0.760 or greater. In another embodiment, the CoR of a golf ball core at 125 ft/s is about 0.770 or greater, or about 0.780 or greater, or about 0.790 or greater. In yet another embodiment, the CoR of a golf ball core at 125 ft/s is about 0.800 or greater, or about 0.810 or greater, or about 0.820 or greater. In still another embodiment, the overall CoR of a golf ball core at 125 ft/s is about 0.830 or greater, or about 0.840 or greater, or about 0.850 or greater. In a further embodiment, the CoR of a golf ball core at 125 ft/s is about 0.860 or greater, or about 0.880 or greater, or about 0.900 or greater.

In other cases, it may be desirable to produce a golf ball core having a relatively low CoR value. In one embodiment, the CoR of a golf ball core made from the core composition of the present disclosure at 125 ft/s is about 0.770 or less, or about 0.760 or less, or about 0.740 or less. In another embodiment, the CoR of a golf ball core at 125 ft/s is about 0.730 or less, or about 0.720 or less, or about 0.710 or less. In a further embodiment, the CoR of a golf ball core at 125 ft/s is about 0.700 or less, or about 0.690 or less, or about 0.680 or less. In yet another embodiment, the CoR of a golf ball core at 125 ft/s is about 0.660 or less, or about 0.640 or less, or about 0.620, or about 0.600 or less.

In further cases, it may be desirable to produce a golf ball core having a CoR value within a particular range. In one embodiment, the CoR of a golf ball core made from the core composition of the present disclosure at 125 ft/s may range from about 0.600 to about 0.700 or about 0.620 to about 0.660 or about 0.640 to about 0.680. In another embodiment, the CoR of a golf ball core at 125 ft/s may range from about 0.700 to about 0.800 or about 0.720 to about 0.760 or about 0.740 to about 0.780. In still another embodiment, the CoR of a golf ball core at 125 ft/s may range from about 0.750 to about 0.850 or about 0.770 to about 0.810 or about 0.790 to about 0.830. In yet another embodiment, the CoR of a golf ball core at 125 ft/s may range from about 0.850 to about 0.950 or about 0.870 to about 0.910 or about 0.890 to about 0.930.

The finished golf balls of the present disclosure may be tailored to have a desired and/or targeted CoR value. In some cases, it may be desirable to produce a golf ball core having a relatively high CoR value. In one embodiment, the CoR of a finished golf ball made from the core composition of the present disclosure at 125 ft/s is about 0.770 or greater, or about 0.780 or greater, or about 0.790 or greater. In another embodiment, the CoR of a finished golf ball at 125 ft/s is about 0.770 or greater, or about 0.780 or greater, or about 0.790 or greater. In yet another embodiment, the CoR of a finished golf ball at 125 ft/s is about 0.800 or greater, or about 0.810 or greater, or about 0.820 or greater. In still another embodiment, the overall CoR of a finished golf ball at 125 ft/s is about 0.830 or greater, or about 0.840 or greater, or about 0.850 or greater. In a further embodiment, the CoR of a finished golf ball at 125 ft/s is about 0.860 or greater, or about 0.880 or greater, or about 0.900 or greater.

In other cases, it may be desirable to produce a finished golf ball having a relatively low CoR value. In one embodiment, the CoR of a finished golf ball made with the core composition of the present disclosure at 125 ft/s is about 0.760 or less, or about 0.750 or less, or about 0.740 or less. In another embodiment, the CoR of a finished golf ball at 125 ft/s is about 0.730 or less, or about 0.720 or less, or about 0.710 or less. In a further embodiment, the CoR of a finished golf ball at 125 ft/s is about 0.700 or less, or about 0.690 or less, or about 0.680 or less. In yet another embodiment, the CoR of a finished golf ball at 125 ft/s is about 0.660 or less, or about 0.640 or less, or about 0.620, or about 0.600 or less.

In further cases, it may be desirable to produce a finished golf ball having a CoR value within a particular range. In one embodiment, the CoR of a finished golf ball made with the core composition of the present disclosure at 125 ft/s may range from about 0.600 to about 0.700 or about 0.620 to about 0.660 or about 0.640 to about 0.680. In another embodiment, the CoR of a finished golf ball at 125 ft/s may range from about 0.700 to about 0.800 or about 0.720 to about 0.760 or about 0.740 to about 0.780. In still another embodiment, the CoR of a finished golf ball at 125 ft/s may range from about 0.750 to about 0.850 or about 0.770 to about 0.810 or about 0.790 to about 0.830. In yet another embodiment, the CoR of a finished golf ball at 125 ft/s may range from about 0.850 to about 0.950 or about 0.870 to about 0.910 or about 0.890 to about 0.930.

Cover Properties

The properties of a golf ball cover (or layers of the cover) formed with a cover composition of the present disclosure are discussed below.

Hardness

The cover layer, or in embodiment having a multi-layer core, the outer cover layer preferably has a material hardness of 85 Shore C or less. For example, in one embodiment, the cover layer or outer cover layer has a hardness of about 65 to about 85 Shore C or about 65 to about 80 Shore C or about 70 to about 85 Shore C or about 70 to about 80 Shore C. In another embodiment, the hardness of the cover layer or outer cover layer is about 65 to about 75 Shore C to about 65 to about 70 Shore C or about 70 to about 75 Shore C or about 67 to about 73 Shore C or about 66 to about 69 Shore C or about 71 to about 74 Shore C. In yet another embodiment, the hardness of the cover layer or outer cover layer is about 75 to about 85 Shore C to about 75 to about 80 Shore C or about 80 to about 85 Shore C or about 77 to about 83 Shore C or about 76 to about 79 Shore C or about 81 to about 84 Shore C. Methods for measuring hardness of the layers in the golf ball are described in further detail above.

When included, the inner cover layer preferably has a material hardness within a range having a lower limit of 70 or 75 or 80 or 82 Shore C and an upper limit of 85 or 86 or 90 or 92 Shore C. For example, in one embodiment, the inner cover layer may have a hardness of about 70 to about 92 Shore C or about 70 to about 86 Shore C or about 75 to about 92 Shore C or about 75 to about 86 Shore C. In another embodiment, the inner cover layer may have a hardness of about 70 to about 81 Shore C or about 70 to about 75 Shore C or about 76 to about 81 Shore C or about 73 to about 78 Shore C. In another embodiment, the inner cover layer may have a hardness of about 81 to about 92 Shore C or about 81 to about 86 Shore C or about 86 to about 92 Shore C or about 83 to about 89 Shore C.

Thickness

The thickness of the cover is preferably within a range having a lower limit of 0.010 or 0.015 or 0.025 inches and an upper limit of 0.035 or 0.040 or 0.055 or 0.080 inches. When the cover is a multi-layer cover, the inner cover layer or intermediate layer may have a thickness of about 0.01 inches to about 0.06 inches, about 0.015 inches to about 0.040 inches, or about 0.02 inches to about 0.035 inches. In other embodiments, the thickness of the inner cover layer or intermediate layer is preferably within a range having a lower limit of 0.010 or 0.015 or 0.020 or 0.030 inches and an upper limit of 0.035 or 0.045 or 0.080 or 0.120 inches. The outer cover layer may have a thickness of about 0.015 inches to about 0.055 inches, about 0.02 inches to about 0.04 inches, or about 0.025 inches to about 0.035 inches.

Coefficient of Restitution

A golf ball cover of the present disclosure may be tailored to produce a finished golf ball with a desired and/or targeted CoR value. In some cases, the golf ball cover together with the golf ball core may be tailored to produce a finished golf ball with a desired and/or targeted CoR value. In some cases, it may be desirable to produce a finished golf ball having a relatively low CoR value. In one embodiment, the CoR of a finished golf ball made in accordance with the present disclosure at 125 ft/s is about 0.770 or greater, or about 0.780 or greater, or about 0.790 or greater. In another embodiment, the CoR of a finished golf ball at 125 ft/s is about 0.770 or greater, or about 0.780 or greater, or about 0.790 or greater. In yet another embodiment, the CoR of a finished golf ball at 125 ft/s is about 0.800 or greater, or about 0.810 or greater, or about 0.820 or greater. In still another embodiment, the overall CoR of a finished golf ball at 125 ft/s is about 0.830 or greater, or about 0.840 or greater, or about 0.850 or greater. In a further embodiment, the CoR of a finished golf ball at 125 ft/s is about 0.860 or greater, or about 0.880 or greater, or about 0.900 or greater.

In other cases, it may be desirable to produce a finished golf ball having a relatively low CoR value. In one embodiment, the CoR of a finished golf ball made in accordance with the present disclosure at 125 ft/s is about 0.760 or less, or about 0.750 or less, or about 0.740 or less. In another embodiment, the CoR of a finished golf ball at 125 ft/s is about 0.730 or less, or about 0.720 or less, or about 0.710 or less. In a further embodiment, the CoR of a finished golf ball at 125 ft/s is about 0.700 or less, or about 0.690 or less, or about 0.680 or less. In yet another embodiment, the CoR of a finished golf ball at 125 ft/s is about 0.660 or less, or about 0.640 or less, or about 0.620, or about 0.600 or less.

In further cases, it may be desirable to produce a finished golf ball having a CoR value within a particular range. In one embodiment, the CoR of a finished golf ball made in accordance with the present disclosure at 125 ft/s may range from about 0.600 to about 0.700 or about 0.620 to about 0.660 or about 0.640 to about 0.680. In another embodiment, the CoR of a finished golf ball at 125 ft/s may range from about 0.700 to about 0.800 or about 0.720 to about 0.760 or about 0.740 to about 0.780. In still another embodiment, the CoR of a finished golf ball at 125 ft/s may range from about 0.750 to about 0.850 or about 0.770 to about 0.810 or about 0.790 to about 0.830. In yet another embodiment, the CoR of a finished golf ball at 125 ft/s may range from about 0.850 to about 0.950 or about 0.870 to about 0.910 or about 0.890 to about 0.930.

Golf Ball Construction

Golf balls having various constructions may be made in accordance with this invention. For example, golf balls may have one-piece, two-piece, three-piece, four-piece, five-piece, and six or more-piece constructions. The term "piece" as used herein may refer to any core, cover, or intermediate layer of a golf ball construction. Representative illustrations of such golf ball constructions are provided and discussed further below. The term "layer" as used herein means generally any spherical portion of the golf ball.

Figure 2:
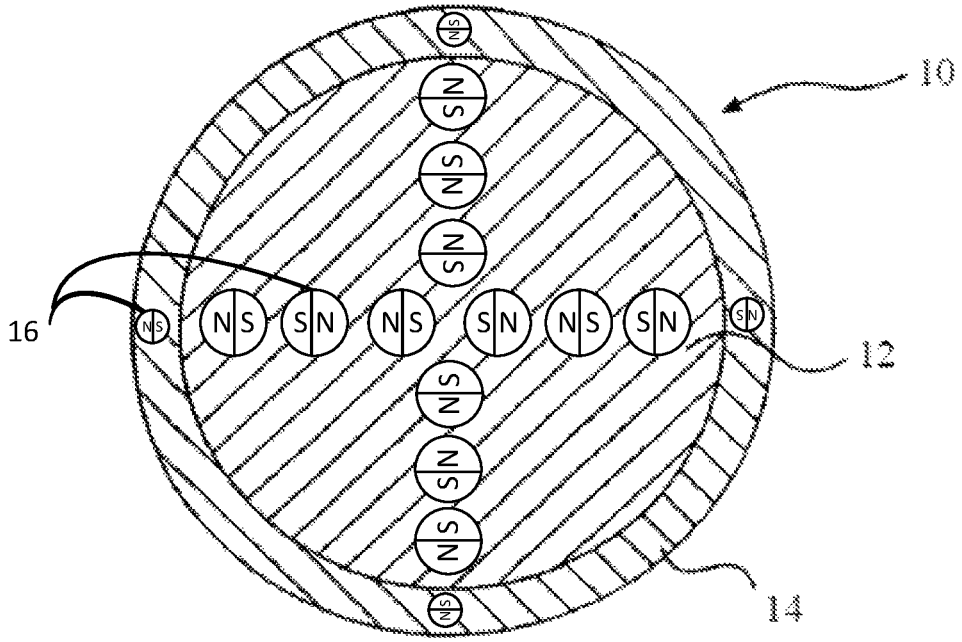
FIG. 2 is another cross-sectional view of a two-piece golf ball in accordance with an embodiment of the present disclosure.
Figure 3:
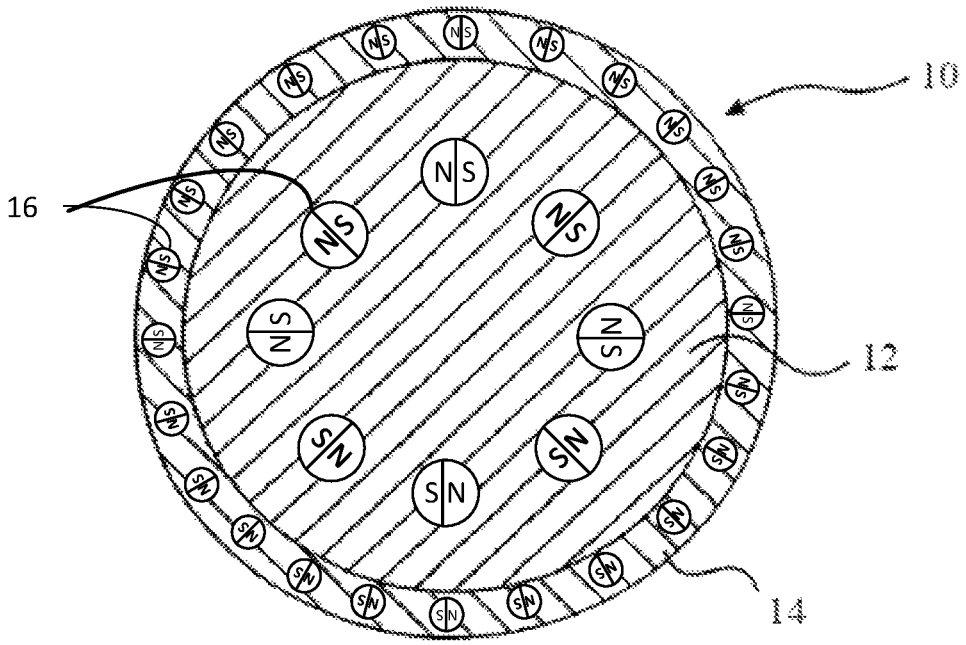
FIG. 3 is yet another cross-sectional view of a two-piece golf ball in accordance with an embodiment of the present disclosure.
Figure 4:
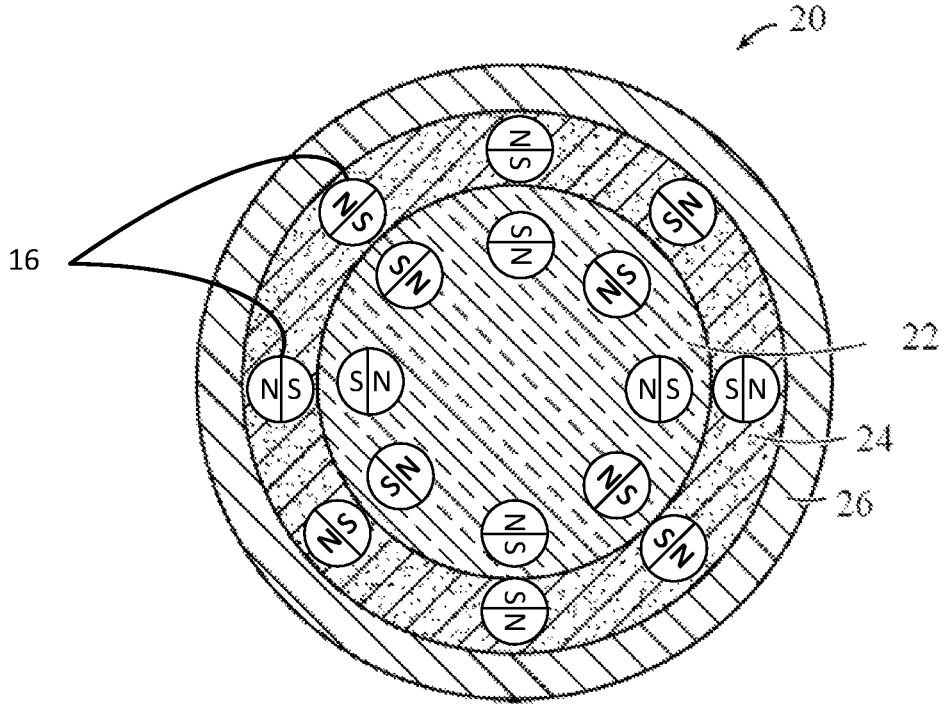
FIG. 4 is a cross-sectional view of a three-piece golf ball in accordance with an embodiment of the present disclosure.
Figure 5:
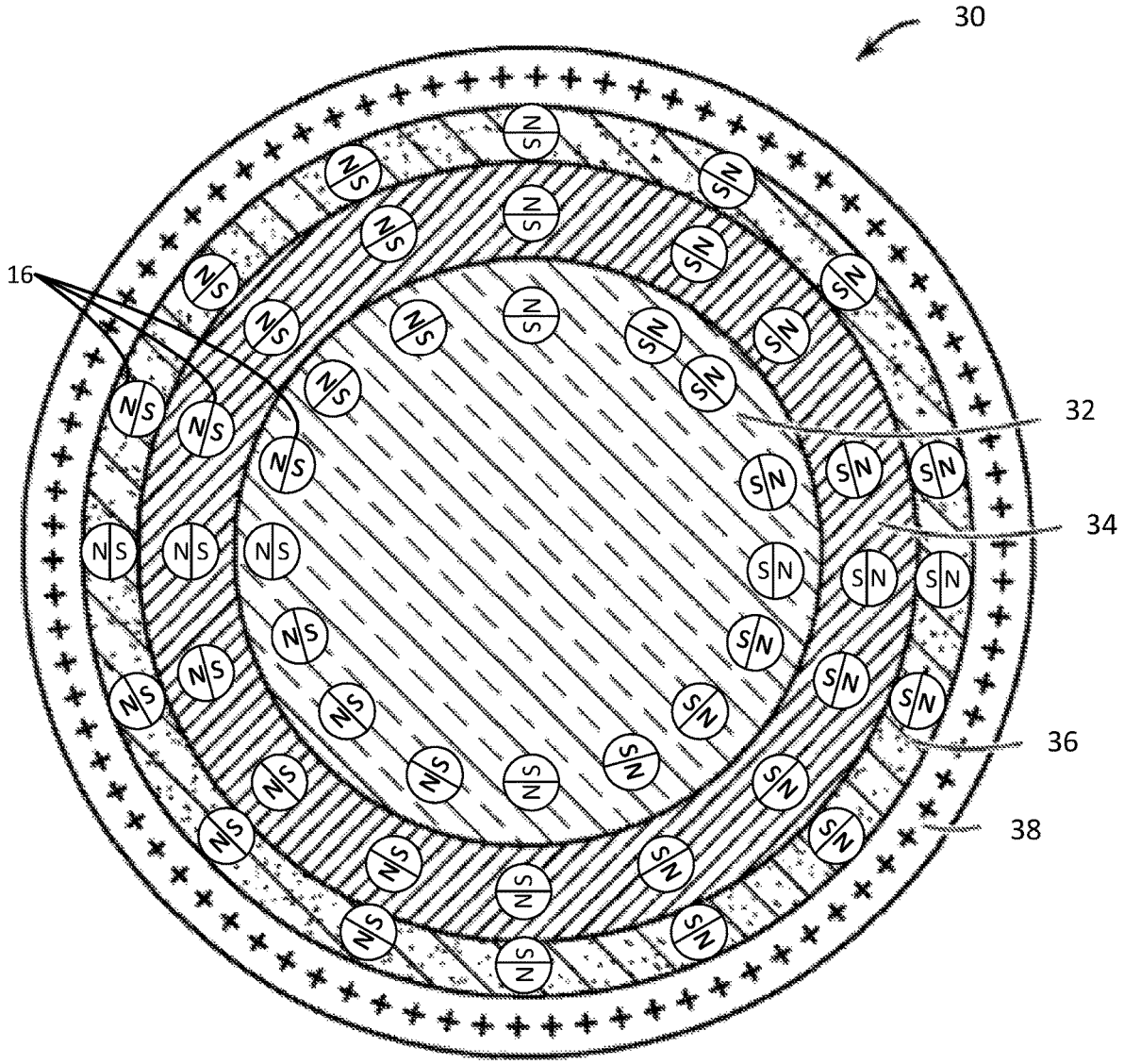
FIG. 5 is a cross-sectional view of a four-piece golf ball in accordance with an embodiment of the present disclosure.
Figure 6:
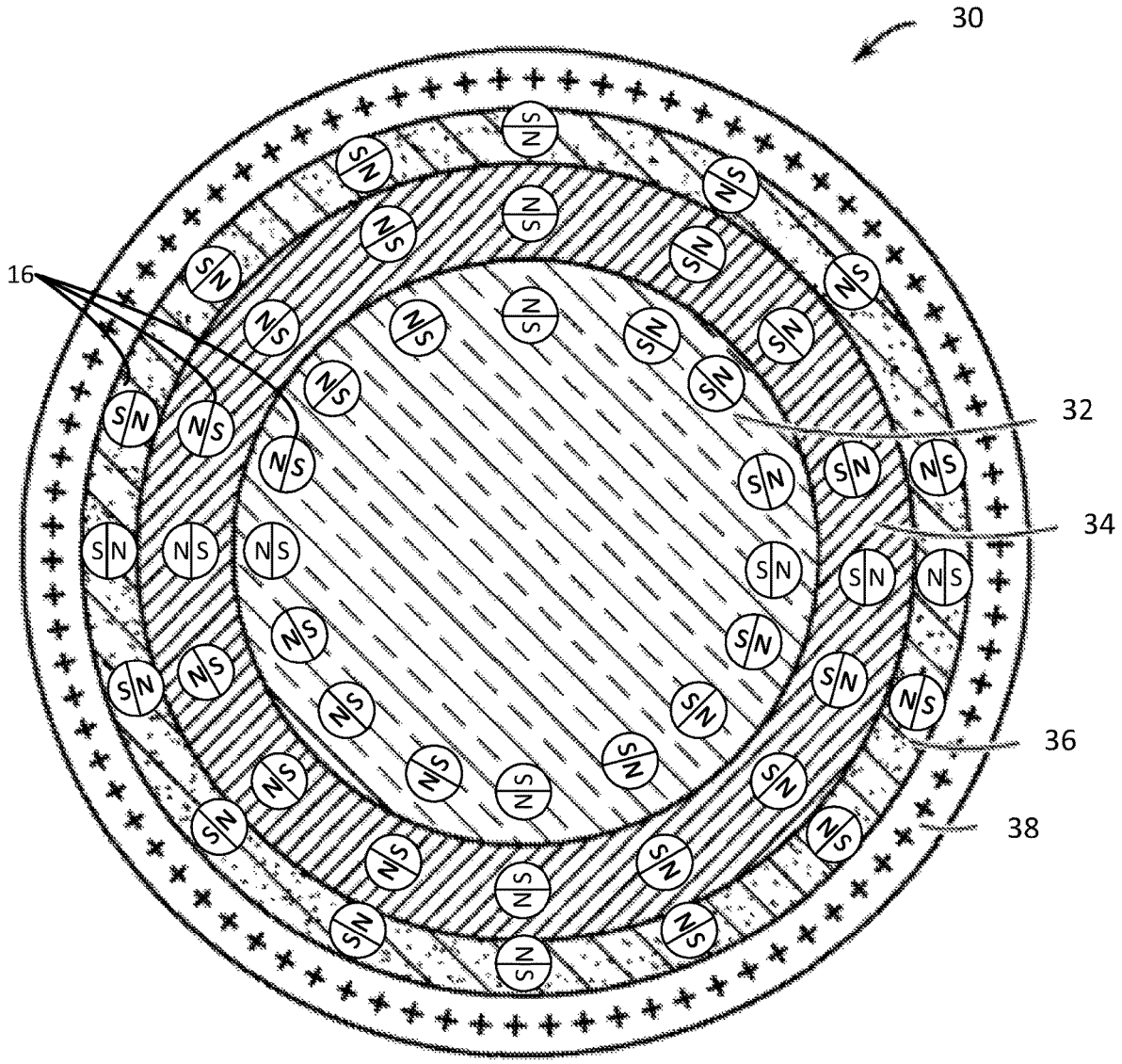
FIG. 6 is another cross-sectional view of a four-piece golf ball in accordance with an embodiment of the present disclosure.
Figure 7:
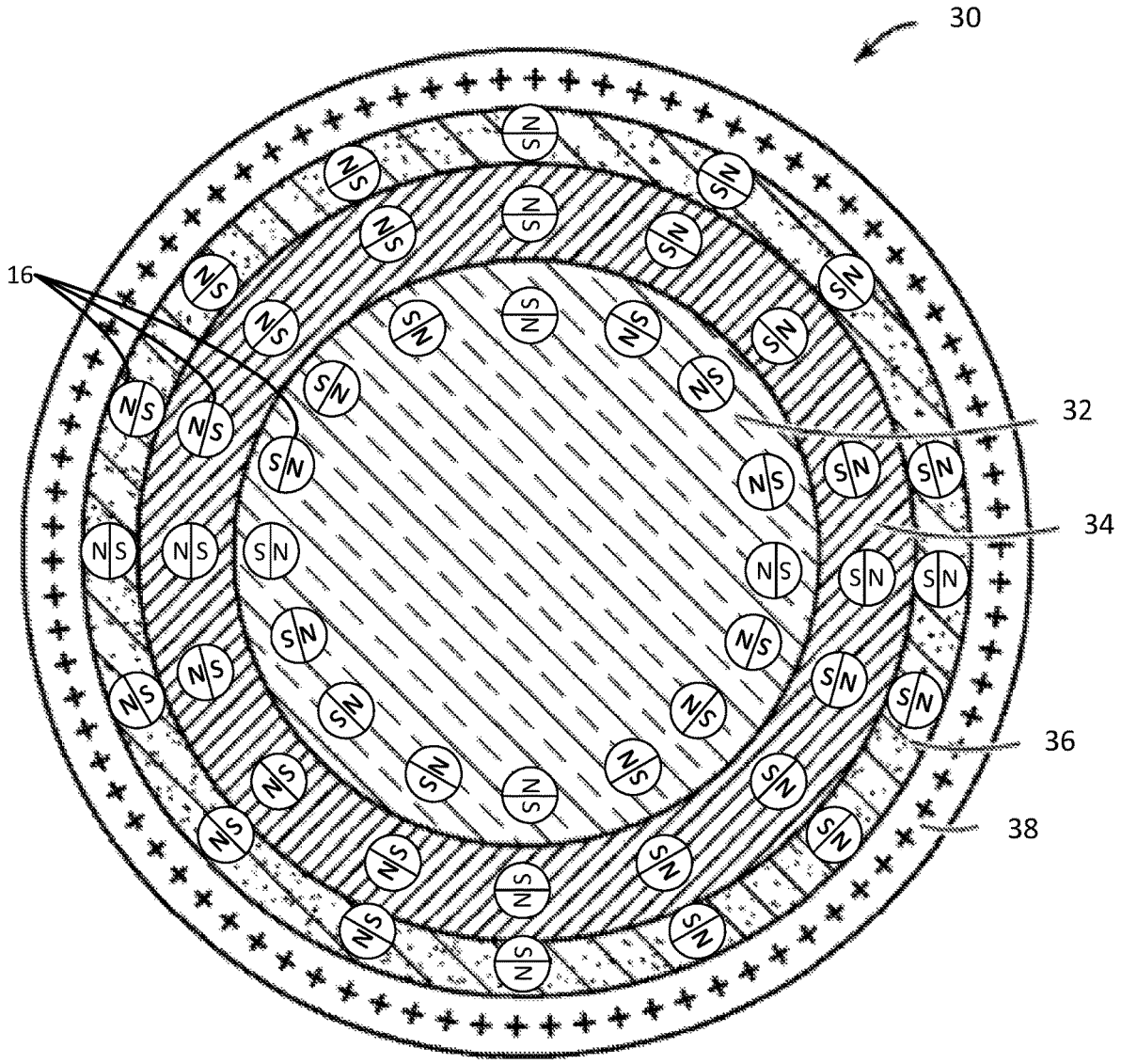
FIG. 7 is yet another a cross-sectional view of a four-piece golf ball in accordance with an embodiment of the present disclosure.
Figure 8:
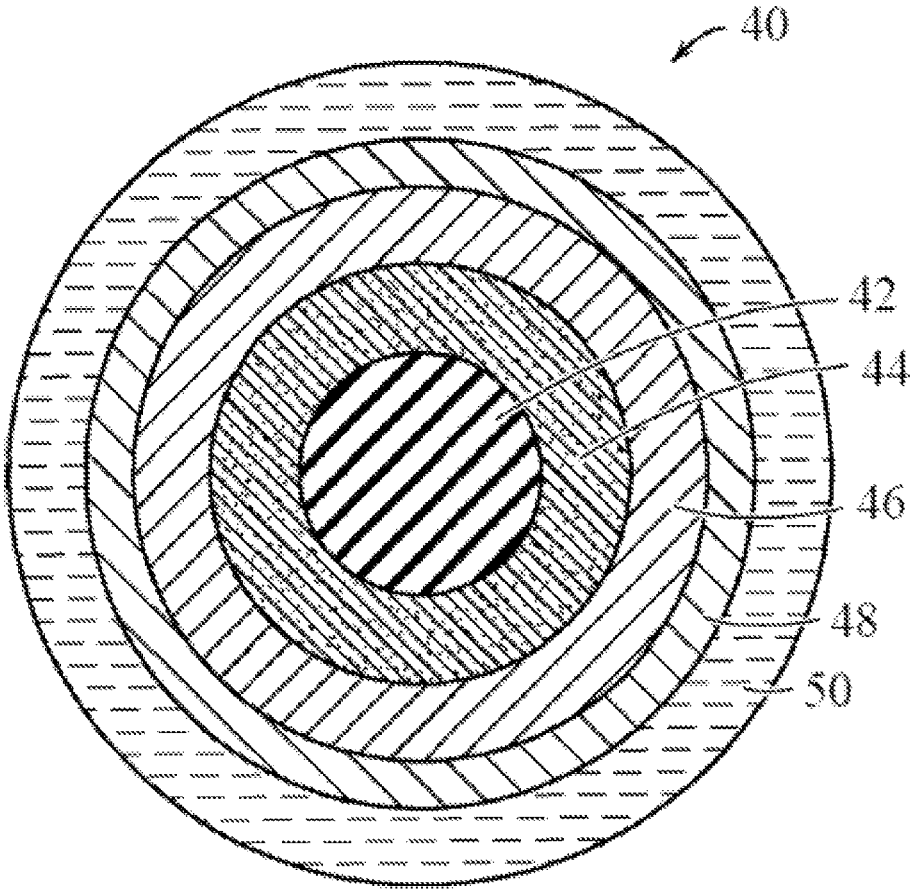
FIG. 8 is a cross-sectional view of a five-piece golf ball in accordance with an embodiment of the present disclosure.

In one embodiment, a golf ball of the present disclosure is a one-piece ball where the core and cover form a single integral layer. In another embodiment, shown in FIGS. 1-3, a golf ball of the present disclosure is a two-piece ball 10 including a single core 12 and a single cover layer 14. In FIGS. 1-3, the single core 12 and single cover layer 14 both include magnets 16. As shown in FIG. 4, in a further embodiment, the golf ball 20 includes a core 22, an intermediate layer 24, and a cover layer 26. In FIG. 4, the intermediate layer 24 can be considered an outer core layer, an inner cover layer, a mantle or casing layer, or any other layer disposed between the core 22 and the cover layer 26. Referring to FIGS. 5-7, in yet another embodiment, a four-piece golf ball 30 includes an inner core 32, an outer core layer 34, an intermediate layer 36, and an outer cover layer 38. In FIGS. 5-7, the intermediate layer 36 may be considered a casing or mantle layer, or inner cover layer, or any other layer disposed between the outer core layer 34 and the outer cover of the ball 38. Referring to FIG. 8, in still another version, a five-piece golf ball 40 includes a three-layered core having an inner core 42, an intermediate core layer 44, an outer core layer 46, an inner cover layer 48, and an outer cover layer 50. In a further embodiment, a six-piece golf ball includes an inner core, an intermediate core layer, an outer core layer, an intermediate layer, an inner cover layer, and an outer cover layer. As exemplified herein, a golf ball in accordance with the present disclosure can include any combination of any number of core layers, intermediate layers, and cover layers.

While the core and cover compositions including a resiliency additive discussed herein are suitable for use in a golf ball core and cover, respectively, it is also contemplated that compositions formed in accordance with the present disclosure may be used to form one or more other layers of any of the one, two, three, four, or five, or more-piece (layered) balls described above. That is, any of the core layers, intermediate layers, and/or cover layers may include the core or cover compositions of this disclosure. Particularly, an intermediate layer, if present, may be formed from the core or cover compositions including a resiliency additive as disclosed herein. The core or cover compositions of different layers may be the same or different. The diameter and thickness of the different layers along with properties such as hardness and compression may vary depending upon the construction and desired performance characteristics of the golf ball.

As discussed above, one or more of the core layers, intermediate layers, or cover layers may include a resiliency additive. In one embodiment, one or more of the core layers, intermediate layers, or cover layers may include a plurality of resiliency additives. In another embodiment, one or more of the core layers, intermediate layers, or cover layers may be entirely composed of a resiliency additive. In such embodiments, the polymeric network of the resiliency additive of such layer may itself be entirely composed of a core or cover composition in accordance with the present disclosure, i.e., the polymeric network and the composition for such layer may be the same component. In yet another embodiment, a resiliency additive, or a magnet or polymer network of a resiliency additive, may be disposed in more than one layer. That is, the polymer network and magnets in the polymer network may extend between or be located in different layers simultaneously.

Figure 9:
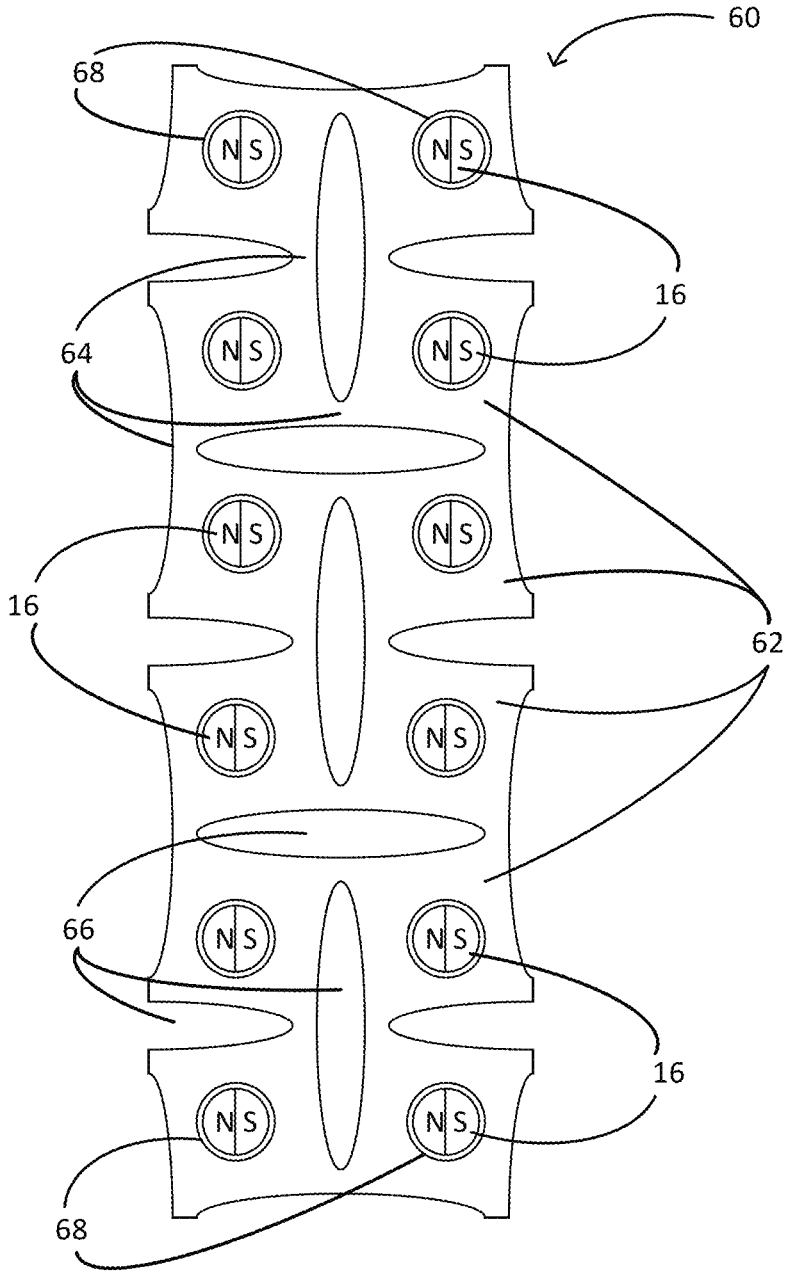
FIG. 9 is a cross-sectional view of a polymeric network in accordance with an embodiment of the present disclosure.

As shown in FIG. 9 and discussed elsewhere herein, the polymeric network 60 may include a plurality of subunits 62, also referred to herein as plates 62. The subunits 62 may be arranged to give the polymeric network 60 a desired shape. In some embodiments, the polymeric network 60 may be in the shape of a chain as shown in FIG. 9. In some embodiments, each plate 62 forming the polymeric network 60 may be connected to one or more other plates 62 by one or more ligaments 64 as shown in FIG. 9. Further, the polymeric network 60 may include a plurality of pores 66 to allow for expansion and compression of the polymeric network 60. Each plate 62 may also have one or more cavities 68 for receiving and securing magnets 16 as shown in FIG. 9.

Without being bound to any particular theory, the orientation of the magnets in the resiliency additive may affect the phase transitions of the polymeric network in the resiliency additive, which in turn may affect the CoR of a golf ball made with a core or cover composition of the present disclosure including the resiliency additive. The magnets may be oriented such that they have an attractive, repulsive, or neutral interaction with neighboring magnets. For example, a magnet may have an attractive interaction with a neighboring magnet when one of the poles of the magnet is nearer to the opposite pole of the neighboring magnet than it is to the same pole of the neighboring magnet, i.e., the north or south pole of the magnet is nearer to the south or north pole, respectively. In contrast, a magnet may have a repulsive interaction with a neighboring magnet when one pole of the magnet is nearer to the same pole of the neighboring magnet than it is to the opposite pole of the neighboring magnet, i.e., the north or south pole of the magnet is nearer to the north or south pole, respectively. Neighboring magnets may have a neutral interaction when there is neither an attractive nor repulsive interaction between the magnets. Without being bound by any particular theory, when neighboring magnets in a golf ball component made in accordance with the present disclosure exhibit attractive forces, the CoR of the golf ball component generally decreases. In contrast, when neighboring magnets in a golf ball component of the present disclosure exhibit repulsive forces, the CoR of the golf ball component generally increases.

Moreover, the strength of the forces between magnets may be altered by manipulating the distance between the magnets. For example, moving the north pole of a magnet closer to the north pole of another magnet may increase the repulsive force between the magnets while moving the north pole of a magnet closer to the south pole of another magnet may increase the attractive force between the magnets. Without being bound to any particular theory, for a resiliency additive including a polymeric network and a plurality of magnets in the polymeric network in accordance with the present disclosure, the type and strength of the interactions of the magnets in the polymeric network affects phase transition of the polymeric network in the resiliency additive and, in turn, the CoR of the golf ball component or golf ball including the resiliency additive.

Core and cover compositions including a resiliency additive made according to the present disclosure may be formed into a core or cover such that the magnets in the resiliency additive may be oriented to either attract or repel each of the neighboring magnets. In other embodiments, the magnets in the resiliency additive of a composition used to form one or more of the core layers, intermediate layers, or cover layers of a golf ball may be oriented to attract some neighboring magnets and/or repel other neighboring magnets. It may be desirable to construct one or more of the core layers, intermediate layers, or cover layers containing a resiliency additive such that the magnets in the resiliency additive attract or repel neighboring magnets in a particular direction. In some embodiments, such as the embodiment shown in FIG. 1, the magnets in the resiliency additive may attract or repel other magnets in an axial direction, i.e., in a direction parallel to an axis of the golf ball. In FIG. 1, the magnets are configured to attract neighboring magnets in an axial direction. When the magnets in the resiliency additive attract or repel other magnets in an axial direction, the direction of the magnetic moment of each magnet may be substantially parallel to each other magnet and/or to an axis of the golf ball. In other embodiments, such as the embodiment shown in FIG. 2, the magnets in the resiliency additive may attract or repel neighboring magnets radially, i.e., in a direction moving from outward from or inward to the geometric center of the golf ball. In FIG. 2, the magnets are configured to repel neighboring magnets radially. When the magnets in the resiliency additive attract or repel other magnets radially, the direction of the magnetic moment of each magnet may be substantially colinear with a radius of the golf ball core or a line passing through the geometric center of the golf ball. In still other embodiments, such as the embodiment shown in FIG. 3, the magnets in the resiliency additive may attract or repel neighboring magnets circumferentially, i.e., in a circular direction moving around the center of the golf ball. In FIG. 3, the magnets are configured to attract neighboring magnets circumferentially. When the magnets in the resiliency additive attract or repel other magnets circumferentially, the direction of the magnetic moment of each magnet may be substantially tangent to a circle with its center at the geometric center of the golf ball and intersecting the magnet.

In a golf ball having two or more layers, including core layers, intermediate layers, or cover layers, including a resiliency additive, the magnets in the resiliency additive of one layer may be oriented to attract or repel the magnets in the resiliency additive of another layer. For example, in a golf ball core having an inner core layer and an outer core layer, such as the embodiment shown in FIG. 4, the magnets in the inner core layer may attract or repel the magnets in the outer core layer. In FIG. 4, the magnets in the inner core layer are configured to repel neighboring magnets in the outer core layer. In embodiments of a golf ball core having three or more layers, the magnets in a given layer may attract or repel the magnets in an adjacent layer. For example, in some embodiments of a three-layer golf ball core having an inner core layer, an intermediate core layer, and an outer core layer, such as the embodiment shown in FIG. 5, the magnets in the intermediate core layer may attract or repel the magnets in both the inner core layer and outer core layer. In FIG. 5, the magnets in the intermediate later are configured to attract neighboring magnets in the inner core layer and outer core layer. In other embodiments of a three-layer golf ball core, such as the embodiment shown in FIG. 6, the magnets of the intermediate layer may attract the magnets in the inner core layer and repel the magnets in the outer core layer. In still other embodiments of a three-layer golf ball core, such as the embodiment shown in FIG. 7, the magnets of the intermediate layer may repel the magnets in the inner core layer and attract the magnets in the outer core layer.

In some embodiments, the layers disposed around other layers including a resiliency additive may include a magnetic shielding agent. For example, when a resiliency additive is included in the core composition of the core but not in the cover composition of the cover layer, or if present, an intermediate layer, the cover layer or intermediate layer may include a shielding agent. In other embodiments, the layers disposed between two other layers including a resiliency additive may compromise a magnetic shielding agent. For example, in an embodiment having a core with a core composition including a resiliency additive, a cover having a cover composition including a resiliency additive, and an intermediate layer having a composition not including a resiliency additive, the intermediate layer may include a magnetic shielding agent. Without being bound to any particular theory, the magnetic shielding agent may be used to reduce the interaction between the magnets in the resiliency additive of different layers or may be used to reduce the interaction between magnets in the resiliency additive of one or more layers and objects outside the golf ball, such as the face of a golf club or a metal flag stick. The magnetic shielding agent may be a ferromagnetic material. Examples of magnetic shielding agents include, but are not limited to, iron, nickel, cobalt, and alloys thereof. A non-limiting example of a commercially available shielding agent includes MuMetal® manufactured by Magnetic Shield Corporation.

The phase change of the resiliency additive may be directional in that it may occur when acted on by a force in a particular direction. The golf ball core may be constructed such that the phase change of the resiliency additive of a golf ball core occurs in a desired direction. In some embodiments, the phase change of the resiliency additive may occur in a single, linear direction parallel to an axis of the golf ball core. In another embodiment, the phase change of the resiliency additive may occur radially. In yet another embodiment, the phase change of the resiliency additive may occur circumferentially.

Golf balls made in accordance with this invention can be of any size, although the USGA requires that golf balls used in competition have a diameter of at least 1.68 inches. For play outside of United States Golf Association (USGA) rules, the golf balls can be of a smaller size. In one embodiment, golf balls made in accordance with this invention have a diameter in the range of about 1.68 to about 1.80 inches.

When the core (or, when the golf ball core is a multi-layered core, one or more layers of the core) of a golf ball formed in accordance with the present disclosure does not include a resiliency additive, such core or core layer may be formed from a core composition that includes any one of the base rubbers discussed previously. In one embodiment, such a core composition includes a base rubber in an amount of about 5 percent to 100 percent by weight based on total weight of formulation. In another embodiment, the base rubber is included in the core composition in an amount within a range having a lower limit of about 5 percent or 10 percent or 20 percent or 30 percent or 40 percent or 50 percent and an upper limit of about 55 percent or 60 percent or 70 percent or 80 percent or 90 percent or 95 percent or 100 percent. For example, the base rubber may be present in the core composition in an amount of about 40 percent to about 95 percent by weight based on the total weight of the formulation. In one embodiment, the core composition includes about 55 percent to about 95 percent base rubber based on the total weight of the formulation.

The base rubber may be polybutadiene, polyisoprene, ethylene propylene rubber, ethylene-propylene-diene rubber, styrene-butadiene rubber, styrenic block copolymer rubbers, polyalkenamers such as, for example, polyoctenamer, butyl rubber, halobutyl rubber, polystyrene elastomers, polyethylene elastomers, polyurethane elastomers, polyurea elastomers, metallocene-catalyzed elastomers and plastomers, copolymers of isobutylene and p-alkylstyrene, halogenated copolymers of isobutylene and p-alkylstyrene, copolymers of butadiene with acrylonitrile, polychloroprene, alkyl acrylate rubber, chlorinated isoprene rubber, acrylonitrile chlorinated isoprene rubber, and blends of two or more thereof. In one embodiment, the core composition includes polybutadiene rubber, butyl rubber, or a blend thereof as the base rubber.

Further, core compositions not including a resiliency additive may include a reactive cross-linking co-agent. Suitable co-agents include, but are not limited to, metal salts of unsaturated carboxylic acids having from 3 to 8 carbon atoms; unsaturated vinyl compounds and polyfunctional monomers (e.g., trimethylolpropane trimethacrylate); phenylene bismaleimide; and combinations thereof. In one embodiment, the co-agent is one or more metal salts of acrylates, diacrylates, methacrylates, and dimethacrylates, wherein the metal is selected from magnesium, calcium, zinc, aluminum, lithium, and nickel. In another embodiment, the co-agent includes one or more zinc salts of acrylates, diacrylates, methacrylates, and dimethacrylates. For example, the co-agent may be zinc diacrylate (ZDA). In another embodiment, the co-agent may be zinc dimethacrylate (ZDMA).

The co-agent may be included in the core composition in varying amounts depending on the specific core component for which the core composition is intended. In one embodiment, the amount of co-agent used in the core compositions increases for each outer component of the core assemblage. In other words, the co-agent in the core composition for the center is included in a first amount and the co-agent in the core composition for the outer core layer is included in a second amount. The second amount may be more than the first amount. In this aspect, the first amount may be about 25 percent to about 90 percent of the second amount. For example, the first amount may be about 40 percent to about 80 percent of the second amount. In one embodiment, the first amount is about 60 percent to about 75 percent of the second amount.

Radical scavengers such as a halogenated organosulfur, organic disulfide, or inorganic disulfide compounds may also be added to core compositions not including a resiliency additive. In one embodiment, a halogenated organosulfur compound included in the core composition includes, but is not limited to, pentachlorothiophenol (PCTP) and salts of PCTP such as zinc pentachlorothiophenol (ZnPCTP). In another embodiment, ditolyl disulfide, diphenyl disulfide, dixylyl disulfide, 2-nitroresorcinol, and combinations thereof are added to the core composition.

The core composition may be cured using conventional curing processes. Non-limiting examples of curing processes suitable for use in accordance with the present invention include peroxide-curing, sulfur-curing, high-energy radiation, and combinations thereof. In one embodiment, the core composition includes a free-radical initiator selected from organic peroxides, high energy radiation sources capable of generating free-radicals, and combinations thereof. Suitable organic peroxides include, but are not limited to, dicumyl peroxide; n-butyl-4,4-di(t-butylperoxy) valerate; 1,1-di(t-butylperoxy)3,3,5-trimethylcyclohexane; 2,5-dimethyl-2,5-di(t-butylperoxy) hexane; di-t-butyl peroxide; di-t-amyl peroxide; t-butyl peroxide; t-butyl cumyl peroxide; 2,5-dimethyl-2,5-di(t-butylperoxy)hexyne-3; di(2-t-butyl-peroxyisopropyl)benzene; dilauroyl peroxide; dibenzoyl peroxide; t-butyl hydroperoxide; and combinations thereof. In a particular embodiment, the free radical initiator is dicumyl peroxide, including, but not limited to Perkadox® BC, commercially available from Akzo Nobel. Peroxide free-radical initiators may be present in the core composition in an amount of at least 0.05 parts by weight per 100 parts of the total rubber, or an amount within the range having a lower limit of 0.05 parts or 0.1 parts or 1 part or 1.25 parts or 1.5 parts or 2.5 parts or 5 parts by weight per 100 parts of the total rubbers, and an upper limit of 2.5 parts or 3 parts or 5 parts or 6 parts or 10 parts or 15 parts by weight per 100 parts of the total rubber. Concentrations are in parts per hundred (phr) unless otherwise indicated. As used herein, the term, "parts per hundred," also known as "phr" or "pph" is defined as the number of parts by weight of a particular component present in a mixture, relative to 100 parts by weight of the polymer component. Mathematically, this can be expressed as the weight of an ingredient divided by the total weight of the polymer, multiplied by a factor of 100.

When the cover of a golf ball formed in accordance with the present disclosure is not formed from a composition including a resiliency additive, such layer(s) may be formed from a variety of materials including any of the base polymers discussed above in the context of the cover composition, for example, polyurethanes; polyureas; copolymers, blends and hybrids of polyurethane and polyurea; olefin-based copolymer ionomer resins; polyethylene, including, for example, low density polyethylene, linear low density polyethylene, and high density polyethylene; polypropylene; rubber-toughened olefin polymers; acid copolymers, for example, poly(meth)acrylic acid, which do not become part of an ionomeric copolymer; plastomers; flexomers; styrene/butadiene/styrene block copolymers; styrene/ethylene-butylene/styrene block copolymers; dynamically vulcanized elastomers; copolymers of ethylene and vinyl acetates; copolymers of ethylene and methyl acrylates; polyvinyl chloride resins; polyamides, poly(amide-ester) elastomers, and graft copolymers of ionomer; cross-linked trans-polyisoprene and blends thereof; polyester-based thermoplastic elastomers; polyurethane-based thermoplastic elastomers; synthetic or natural vulcanized rubber; and combinations thereof.

Likewise, when the layer disposed between the core and the cover (if included) is not formed of a composition including a resiliency additive, conventional and non-conventional materials may be used for forming such layer(s) of the ball including, for instance, ionomer resins, highly neutralized polymers, polybutadiene, butyl rubber, and other rubber-based core formulations, and the like. In one embodiment, the inner cover layer, i.e., the layer disposed between the core and the outer cover, includes an ionomer. In this aspect, ionomers suitable for use in accordance with the present disclosure may include partially-neutralized ionomers and highly-neutralized ionomers (HNPs), including ionomers formed from blends of two or more partially-neutralized ionomers, blends of two or more highly-neutralized ionomers, and blends of one or more partially-neutralized ionomers with one or more highly-neutralized ionomers. For purposes of the present disclosure, "HNP" refers to an acid copolymer after at least 70 percent of all acid groups present in the composition are neutralized.

Suitable ionomers are salts of O/X- and O/X/Y-type acid copolymers, wherein O is an α-olefin, X is a $C_3$-$C_8$ α, β-ethylenically unsaturated carboxylic acid, and Y is a softening monomer. O is preferably selected from ethylene and propylene. X is preferably selected from methacrylic acid, acrylic acid, ethacrylic acid, crotonic acid, and itaconic acid. Methacrylic acid and acrylic acid are particularly preferred. Y is preferably selected from (meth) acrylate and alkyl (meth) acrylates wherein the alkyl groups have from 1 to 8 carbon atoms, including, but not limited to, n-butyl (meth) acrylate, isobutyl (meth) acrylate, methyl (meth) acrylate, and ethyl (meth) acrylate.

"Low acid" and "high acid" ionomeric polymers, as well as blends of such ionomers, may also be used in this context. In general, low acid ionomers are considered to be those containing 16 weight percent or less of acid moieties, whereas high acid ionomers are considered to be those containing greater than 16 weight percent of acid moieties. In one embodiment, the inner cover layer is formed from a composition including a high acid ionomer. A suitable high acid ionomer is Surlyn® 8150 (Dow), which is a copolymer of ethylene and methacrylic acid, having an acid content of 19 weight percent, 45 percent neutralized with sodium. In another embodiment, the inner cover layer is formed from a composition including a high acid ionomer and a maleic anhydride-grafted non-ionomeric polymer. An example of a suitable maleic anhydride-grafted polymer is Fusabond® 525D (Dow), which is a maleic anhydride-grafted, metallocene-catalyzed ethylene-butene copolymer having about 0.9 weight percent maleic anhydride grafted onto the copolymer. Blends of high acid ionomers with maleic anhydride-grafted polymers are further disclosed, for example, in U.S. Pat. Nos. 6,992,135 and 6,677,401, the entire disclosures of which are hereby incorporated herein by reference.

Any of the layers of a golf ball formed in accordance with the present disclosure may include a variety of fillers and additives to impart specific properties to the ball. For example, relatively heavy-weight and light-weight metal fillers such as, particulate; powders; flakes; and fibers of copper, steel, brass, tungsten, titanium, aluminum, magnesium, molybdenum, cobalt, nickel, iron, lead, tin, zinc, barium, bismuth, bronze, silver, gold, and platinum, and alloys and combinations thereof may be used to adjust the specific gravity of the ball. Other additives and fillers include, but are not limited to, optical brighteners, coloring agents, fluorescent agents, whitening agents, UV absorbers, light stabilizers, surfactants, processing aids, antioxidants, stabilizers, softening agents, fragrance components, plasticizers, impact modifiers, titanium dioxide, clay, mica, talc, glass flakes, milled glass, and mixtures thereof.

In one embodiment, the golf balls made in accordance with the present disclosure include a core including a core composition as described herein, an inner cover layer formed from an ionomeric material, and the outer cover layer is formed from a polyurethane material, and the outer cover layer has a hardness that is less than that of the inner cover layer. For example, the inner cover layer may have a hardness of greater than about 60 Shore D and the outer cover layer may have a hardness of less than about 60 Shore D. In an alternative embodiment, the inner cover layer includes a partially or fully neutralized ionomer, a thermoplastic polyester elastomer, a thermoplastic polyether block amide, or a thermoplastic or thermosetting polyurethane or polyurea, and the outer cover layer is composed of an ionomeric material. In this alternative embodiment, the inner cover layer may have a hardness of less than about 60 Shore D and the outer cover layer may have a hardness of greater than about 55 Shore D and the inner cover layer hardness is less than the outer cover layer hardness.

The golf balls of the present disclosure may be formed using a variety of application techniques. For example, the golf ball, golf ball core, or any layer of the golf ball may be formed using compression molding, flip molding, injection molding, retractable pin injection molding, reaction injection molding (RIM), liquid injection molding (LIM), casting, vacuum forming, powder coating, flow coating, spin coating, dipping, spraying, and the like. Conventionally, compression molding and injection molding are applied to thermoplastic materials, whereas RIM, liquid injection molding, and casting are employed on thermoset materials. In this aspect, cover layers may be formed over the core using any suitable technique that is associated with the material used to form the layer. Preferably, each cover layer is separately formed over the core. For example, an ethylene acid copolymer ionomer composition may be injection-molded to produce half-shells over the core. Alternatively, the ionomer composition can be placed into a compression mold and molded under sufficient pressure, temperature, and time to produce the hemispherical shells, which may then be placed around the core in a compression mold. An outer cover layer including a polyurethane or polyurea composition over the ball sub-assembly may be formed by using a casting process.

Golf balls made in accordance with the present disclosure may be subjected to finishing steps such as flash-trimming, surface-treatment, marking, coating, and the like using techniques known in the art. In one embodiment, a white-pigmented cover may be surface-treated using a suitable method such as, for example, corona, plasma, or ultraviolet (UV) light-treatment. Indicia such as trademarks, symbols, logos, letters, and the like may be printed on the cover using pad-printing, ink-jet printing, dye-sublimation, or other suitable printing methods. Clear surface coatings (for example, primer and top-coats), which may contain a fluorescent whitening agent, may be applied to the cover. Golf balls may also be painted with one or more paint coatings in a variety of colors. In one embodiment, white primer paint is applied first to the surface of the ball and then a white top-coat of paint may be applied over the primer.

Unless otherwise defined, all terms (including technical and scientific terms) used herein have the same meaning as commonly understood by one of ordinary skill in the art of this disclosure. It will be further understood that terms, such as those defined in commonly used dictionaries, should be interpreted as having a meaning that is consistent with their meaning in the context of the specification and should not be interpreted in an idealized or overly formal sense unless expressly so defined herein. Well known functions or constructions may not be described in detail for brevity or clarity.

The terms "about" and "approximately" shall generally mean an acceptable degree of error or variation for the quantity measured given the nature or precision of the measurements. Numerical quantities given in this description are approximate unless stated otherwise, meaning that the term "about" or "approximately" can be inferred when not expressly stated.

The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

The terminology used herein is for the purpose of describing particular embodiments only and is not intended to be limiting. As used herein, the singular forms "a", "an" and "the" are intended to include the plural forms as well (i.e., at least one of whatever the article modifies), unless the context clearly indicates otherwise.

The terms "first," "second," and the like are used to describe various features or elements, but these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the disclosure. Likewise, terms like "top" and "bottom"; "front" and "back"; and "left" and "right" are used to distinguish certain features or elements from each other, but it is expressly contemplated that a top could be a bottom, and vice versa.

The golf balls described and claimed herein are not to be limited in scope by the specific embodiments herein disclosed, since these embodiments are intended as illustrations of several aspects of the disclosure. Any equivalent embodiments are intended to be within the scope of this disclosure. Indeed, various modifications of the device in addition to those shown and described herein will become apparent to those skilled in the art from the foregoing description. Such modifications are also intended to fall within the scope of the appended claims. All patents and patent applications cited in the foregoing text are expressly incorporated herein by reference in their entirety. Any section headings herein are provided only for consistency with the suggestions of 37 C.F.R. § 1.77 or otherwise to provide organizational queues. These headings shall not limit or characterize the invention (s) set forth herein.

What is claimed is:

1. A golf ball, comprising:

a core; and a cover layer disposed about the core and comprising a cover composition comprising a resiliency additive, wherein the resiliency additive comprises a plurality of magnets and a polymeric network comprising a plurality of plates containing the plurality of magnets and a plurality of pores disposed between the plurality of plates.

2. The golf ball of claim 1, wherein each of the plurality of plates is connected to one or more other plates of the plurality of plates by one or more ligaments.

3. The golf ball of claim 2, wherein the plurality of plates comprise one or more cavities and the plurality of magnets are contained in the one or more cavities.

4. The golf ball of claim 3, wherein the polymeric network comprises closed and open phases.

5. The golf ball of claim 4, wherein the polymeric network is configured to transition between the open phase and the closed phase when struck by a golf club.

6. The golf ball of claim 1, wherein the plurality of magnets comprises a first magnet and a second magnet, and wherein the first magnet and second magnet are configured to attract each other.

7. The golf ball of claim 1, wherein the plurality of magnets comprises a first magnet and a second magnet, and wherein the first magnet and second magnet are configured to repel each other.

8. The golf ball of claim 1, wherein each magnet in the plurality of magnets comprises a magnetic moment having a direction, and wherein the direction of the magnetic moment of each magnet extends substantially parallel to the magnetic moment of each other magnet.

9. The golf ball of claim 1, wherein the core comprises a geometric center, wherein each magnet in the plurality of magnets comprises a magnetic moment having a direction, and wherein the direction of the magnetic moment of each magnet is substantially colinear with a line passing through the geometric center of the core.

10. The golf ball of claim 1, wherein the resiliency additive is present in the cover composition in an amount of about 5 to about 50 percent by weight.

11. The golf ball of claim 1, wherein the golf ball has a coefficient of restitution between about 0.700 and about 0.950.

12. The golf ball of claim 1, wherein the golf ball has a coefficient of restitution between about 0.500 and about 0.700.

13. The golf ball of claim 1, wherein the plurality of magnets comprises neodymium magnets.

14. A golf ball, comprising:

a core; and a dual cover layer disposed about the core, the cover layer comprising:

an inner cover layer comprising a first cover composition comprising a first resiliency additive; and an outer cover layer disposed over the inner cover layer and comprising a second cover composition, wherein the first resiliency additive comprises a first plurality of magnets and a first polymeric network comprising a first plurality of plates containing the first plurality of magnets and a first plurality of pores disposed between the first plurality of plates.

15. The golf ball of claim 14, wherein the second cover composition comprises a second resiliency additive, and wherein the second resiliency additive comprises a second plurality of magnets.

16. The golf ball of claim 15, wherein the first resiliency additive comprises a first polymeric network comprising a second plurality of plates containing the second plurality of magnets and a second plurality of pores disposed between the second plurality of plates.

17. The golf ball of claim 16, wherein at least one of the magnets in the first plurality of magnets and at least one of the magnets in the second plurality of magnets are configured to attract each other.

18. The golf ball of claim 16, wherein at least one of the magnets in the first plurality of magnets and at least one of the magnets in the second plurality of magnets are configured to repel each other.

19. The golf ball of claim 14, wherein the second cover composition comprises a magnetic shielding agent.

20. The golf ball of claim 15, wherein the golf ball has a coefficient of restitution between about 0.700 and about 0.950.

21. The golf ball of claim 15, wherein the golf ball has a coefficient of restitution between about 0.500 and about 0.700.

* * * * *